United States Patent [19]

Adachi et al.

[11] Patent Number: 5,035,985

[45] Date of Patent: Jul. 30, 1991

[54] SILVER HALIDE PHOTOGRAPHIC DEVELOPMENT AND WASHING PROCESS OF THE CONTAINING ELEMENT

[75] Inventors: Keiichi Adachi; Shigeru Ohno; Kokichi Waki, all of Kanagawa, Japan

[73] Assignee: Fuji Photo Film Co., Ltd., Kanagawa, Japan

[21] Appl. No.: 534,299

[22] Filed: Jun. 7, 1990

Related U.S. Application Data

[63] Continuation of Ser. No. 310,028, Feb. 8, 1989, abandoned, which is a continuation-in-part of Ser. No. 138,112, Dec. 28, 1987, abandoned.

[30] Foreign Application Priority Data

Dec. 25, 1986 [JP] Japan ..... 61-314428
May 6, 1987 [JP] Japan ..... 62-110333

[51] Int. Cl.[5] ..... G03C 1/73

[52] U.S. Cl. ..... 430/432; 430/517; 430/522

[58] Field of Search ..... 430/517, 522, 432

[56] References Cited

U.S. PATENT DOCUMENTS

| | | | |
|---|---|---|---|
| 3,746,539 | 7/1973 | Ohmatsu et al. | 437/522 |
| 3,865,817 | 2/1975 | Kobayashi et al. | 430/522 |
| 3,989,528 | 11/1976 | Sugiyama et al. | 430/522 |
| 4,067,738 | 1/1978 | Sugiyama et al. | 430/522 |
| 4,130,430 | 12/1978 | Gugiyama et al. | 430/522 |
| 4,587,195 | 5/1986 | Ishikawa et al. | 430/522 |

FOREIGN PATENT DOCUMENTS

| | | |
|---|---|---|
| 433504 | 3/1970 | Japan . |
| 49-99602 | 11/1973 | Japan . |
| 50-91627 | 12/1973 | Japan . |
| 1466836 | 3/1977 | United Kingdom . |
| 1466838 | 3/1977 | United Kingdom . |

*Primary Examiner*—Jack P. Brammer
*Attorney, Agent, or Firm*—Sughrue, Mion, Zinn, Macpeak & Seas

[57] ABSTRACT

A method for processing a silver halide photographic element comprising carrying out developement processing, including a washing step, of an imagewise exposed silver halide photographic element, wherein the washing step is carried out at 45° C. or less for 90 sec. or less, and wherein the silver halide color photographic element comprises a support having provided thereon at least one silver halide emulsion layer, wherein the silver halide photographic element contains in a hydrophilic colloid layer, from 2 mg/m$^2$ to 40 mg/n$^2$ of at least one dye represented by the following general formula (I):

(I)

wherein $R_1$ and $R_2$, which can be the same or different, can each represents —$COOR_5$, or $R_3$ and $R_4$, which can be the same or different, each represents a hydrogen atom or an alkyl group, $R_5$ and $R_6$, which can be the same or different, each represents a hydrogen atom, a substituted or unsubstituted alkyl group, a substituted or unsubstituted aryl group, and $R_1$ and $R_2$ represent —$COOR_5$ and $R_5$ represents a hydrogen atom, $R_1$ and $R_2$ represent a carboxyl group which can form a salt, $R_5$ and $R_6$ can combine together to form a 5- or 6-membered ring, $Q_1$ and $Q_2$, which can be the same or different, each represents a substituted or unsubstituted aryl group, $X_1$ and $X_2$, which can be the same or different, each represents a divalent linking group or a bond, $Y_1$ and $Y_2$, which can be the same or different, each represents a sulfo group or a carboxyl group which can form a salt, $L_1$, $L_2$ and $L_3$, which can be the same or different, each represents a substituted or unsubstituted methine group, $m_1$ and $m_2$ each is 1 or 2, n is 0, 1 or 2, $p_1$ and $p_2$ each is 0, 1, 2, 3, or 4, and $s_1$ and $s_2$ each is 1 or 2.

15 Claims, No Drawings

SILVER HALIDE PHOTOGRAPHIC DEVELOPMENT AND WASHING PROCESS OF THE CONTAINING ELEMENT

This is a Continuation of application Ser. No. 07/310,028, filed Feb. 8, 1989, now abandoned, which is a Continuation in Part of application Ser. No. 07/138,112, filed on Dec. 28, 1987 now abandoned.

FIELD OF THE INVENTION

The present invention relates to a method for processing silver halide photographic materials having a dyed hydrophilic colloid layer, and more particularly to silver halide photographic materials having a hydrophilic colloid layer containing a dye that is photochemically inactive and will be decolored and/or will wash out easily during rapid processing.

BACKGROUND OF THE INVENTION

In silver halide photographic materials, it has often been the practice to color a photographic emulsion layer or other layers to allow light having wavelengths in a specified range to be absorbed.

When it is required to control the spectral composition of light that will be incident upon a photographic emulsion layer, a colored layer is usually positioned farther from the support than the photographic emulsion layer on the photographic material. Such a colored layer is called a filter layer. If there are a plurality of photographic emulsion layers such as in multi-layer color photographic materials, a filter layer is usually positioned therebetween.

In order to prevent a smeared image, that is, in order to prevent halation which is often caused when light that has been scattered when the light passes through a photographic emulsion layer or after the light has passed through a photographic emulsion layer is reflected at the interface between the emulsion layer and the support or at the surface of the photographic material opposite to the emulsion layer and thus is again incident upon the photographic emulsion layer, it has been common practice to provide a colored layer between an emulsion layer and a support or on the surface of a support opposite to the photographic emulsion layer. Such a colored layer in this position is called an antihalation layer In the case of a multi-layer color photographic material, sometimes an antihalation layer is placed between layers also.

To prevent the lowering of sharpness of an image due to scattering of light in a photographic emulsion layer (this phenomenon is generally called irradiation), it has also been the practice to color the photographic emulsion layer.

Since, in most cases, the layers to be colored comprise hydrophilic colloids, generally in order to color them, water-soluble dyes are contained therein. It is necessary, however, that these dyes satisfy the following conditions:

(1) the dyes have suitable spectral absorption properties in conformity with the purpose of the application of the material;

(2) the dyes are photochemically inactive; in other words, the dyes do not give an adverse effect on the performance of silver halide photographic emulsion layers chemically (that is, for instance, the dyes do not lower the sensitivity, latent image fading or fog);

(3) the dyes are to be decolored or dissolved and removed during photographic processing thereby leaving no harmful coloring on the photographic material after processing.

To find dyes that satisfy the above conditions, those skilled in the art have given great effort, and the following known dyes are useful in this respect: for instance, oxonol dyes having a pyrazolone nucleus or a barbituric acid nucleus described, for example, in British Patent Nos. 506,385, 1,177,429, 1,311,884, 1,338,799, 1,385,371, 1,467,214, 1,433,102, and 1,553,516, Japanese patent Application (OPI) Nos. 85130/73, 114420/74, 161233/80, and 111640/84 (the term "OPI" as used herein refers to a "published unexamined Japanese patent application"), and U.S. Pat. Nos. 3,247,127, 3,469,985, and 4,078,933, other oxonol dyes described, for example, in U.S. Pat. Nos. 2,533,472 and 3,379,533 and British Patent No. 1,278,621, azo dyes described, for example, in British Patent Nos. 575,691, 680,631, 599,623, 786,907, 907,125, and 1,045,609, U.S. Pat. No. 4,255,326 and Japanese Patent Application (OPI) No. 211043/84, azomethine dyes described, for example, in Japanese Patent Application (OPI) Nos. 100116/75, and 118247/79, and British Patent Nos. 2,014,598 and 750,031, anthraquinone dyes described in U.S. Pat. No. 2,865,752, arylidene dyes described, for example, in U.S. Pat. Nos. 2,538,009, 2,688,541, and 2,538,008, British patent Nos. 584,609, and 1,210,252, Japanese Patent Application (OPI) Nos. 40625/75, 3623/76, 10927/76 and 118247/79, Japanese Patent Publication Nos. 3286/73, and 37303/84, styryl dyes described, for example, in Japanese Patent Publication Nos. 3082/53, 16594/69 and 28898/84, triarylmethane dyes described, for example, in British Patent Nos. 446,583, and 1,335,422 and Japanese Patent Application (OPI) No. 228250/84, merocyanine dyes described, for example, in British Patent Nos. 1,075,653, 1,153,341, 1,284,730, 1,475,228, and 1,542,807 and cyanine dyes described, for example, in U.S. Pat. Nos. 2,843,486 and 3,294,539.

Of these, oxonol dyes having two pyrazolone nuclei have such a nature that they are decolored in a developing solution containing a sulfite and have less adverse effect on photographic emulsions, and they have been used in practice in photographic materials.

However, some dyes belonging to this group have such a defect that even though the dye exhibits less adverse affects on the photographic emulsion itself, the dye spectrally sensitizes a spectrally sensitized emulsion in an undesired spectral wavelength range, or that lowering of sensitivity presumably caused by dislodging a sensitizing dye may take place.

Some dyes belonging to this group remain after processing if the development processing is quickened, and such rapid development processing has been used more and more in practice recently. To obviate this, it has been suggested to use dyes high in reactivity with a sulfite ion, but in such a case, the stability in the photographic film is disadvantageously insufficient, the density lowers with the lapse of time, and the desired photographic effects cannot be obtained.

For example, the dyes described in British Patent 1,466,836 and U.S. Pat. No. 4,587,195 cannot solve the above problems. British Patent 1,466,836 describes oxonol dyes having an aralkyl group, wherein a sulfonic acid group is bonded to the 1-position of the pyrazolone nucleus. These dyes are disadvantageous in that a stain occurs in many cases after processing.

Further, although the dyes of the present invention may be covered by general formula (IV) in U.S. Pat. NO. 4,587,195, wherein m=m=1, U.S. Pat. NO. 4,587,195 neither describes a concrete example of m=m=1 nor describes a difference in effect between m=m=1 and m=m=0. the present inventors have found a difference in effect, that is, although the effect in U.S. Pat. No. 4,587,195 is that a stain can be prevented when the specific processing, the specific sensitizing dye and the irradiation-preventing dye are combined, the present inventors have found that the stain is prevented even without combining the specific processing with the specific sensitizing dye in the case of m=m=1 or 2. Furthermore, it is necessary that the irradiation-preventing dye does not have a bad effect on the photographic properties of the silver halide emulsion layers. The present inventors have also found that such a bad effect is extremely small in the case of m=m=1 or 2, as compared with the case of m=m=0.

SUMMARY OF THE INVENTION

An object of the present invention is to shorten the time for the washing step during development processing when the silver halide color photographic element is subjected to development processing to form a color image.

Another object of the present invention is to provide a dye with which no stain occurs after processing even when a rapid washing step is employed.

A still further object is to provide a dye which does not have a bad effect on the photographic properties of the silver halide photographic emulsion layers.

The above and other objects of the present invention can be obtained by a method for processing a silver halide color photographic element comprising carrying out development processing, including a washing step, of an imagewise exposed silver halide photographic element, wherein the washing step is carried out at 45° C. or less for 90 sec. or less, and the silver halide color photographic element is a silver halide.

The above and other objects of the present photographic material comprising a support having provided thereon at least one silver halide emulsion layer, wherein the silver halide photographic material contains at least one dye represented by the following general formulas (I):

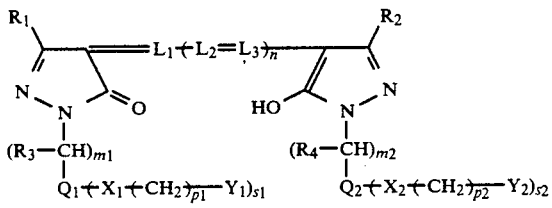

(I)

wherein $R_1$ and $R_2$, which may be the same or different, each represents —$COOR_5$, or

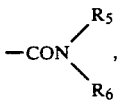

$R_3$ and $R_4$, which may be the same different, each represents a hydrogen atom or an alkyl group, $R_5$ and $R_6$, which may be the same or different, each represents a hydrogen atom, a substituted or unsubstituted alkyl group, a substituted or unsubstituted aryl group, when $R_1$ and $R_2$ represents —$COOR_5$ and $R_5$ represents a hydrogen atom, $R_1$ and $R_2$ represent a carboxyl group which may form a slat, $R_5$ and $R_6$ may combine together to form a 5- or 6-membered ring, $Q_1$ and $Q_2$, which may be the same or different, each represents a substituted or unsubstituted aryl group, $X_1$ and $X_2$, which may be the same or different, each represents a divalent linking group or a bond, $Y_1$ and $Y_2$, which may be the same or different, each represents a sulfo group or a carboxyl group which may form a salt, $L_1$, $L_2$ and $L_3$, which may be the same or different, each represents a substituted or unsubstituted methine group, $m_1$ and $m_2$ each is 1 or 2, n is 0, 1 or 2, $p_1$ and $p_2$ each is 0, 1, 2, 3, or 4, and $s_1$ and $s_2$ each is 1 or 2.

DETAILED DESCRIPTION OF THE INVENTION

In the general formula (I), $R_1$ and $R_2$, which may be the same or different, each represents —$COOR_5$ or

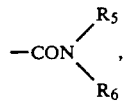

$R_3$ and $R_4$, which may be the same or different, each represents a hydrogen atom, an alkyl group (e.g., a methyl group, an ethyl group, etc.), $R_5$ and $R_6$, which may be the same or different, each represents a hydrogen atom, an alkyl group (e.g., a methyl group, an ethyl group, an isopropyl group, a butyl group, etc.), or a substituted alkyl group {the substituent may be a sulfo group (e.g., a sulfomethyl group, and a sulfoethyl group), a carboxyl group (e.g., a carboxymethyl group and a carboxyethyl group), a hydroxyl group (e.g., a hydroxyethyl group, and a 1,2-dihydroxypropyl group, an alkoxy group (e.g., a methoxyethyl group and an ethoxyethyl group), a halogen atom such as a fluorine atom, a chlorine atom and a bromine atom (e.g., a 2-chloroethyl group, a 2-bromoethyl group, a 2,2,2-trifluoroethyl group), a cyano group (e.g., a cyanoethyl group), a sulfonyl group (e.g., a methanesulfonylethyl group), a nitro group (e.g., a 2-nitrobutyl group, and a 2-nitro-2-methylpropyl group), an amino group (e.g., a dimethylaminoethyl group, and a diethylaminopropyl group), or an aryl group (e.g., a benzyl group, and a p-chlorobenzyl group)}, an aryl group (e.g., a phenyl group), or a substituted aryl group (e.g., a substituted phenyl group) {the substituent for the substituted aryl group may be a sulfo group (e.g., a p-sulfophenyl group and an o,m-disulfophenyl group), a carboxyl group (e.g., a p-carboxyphenyl group, and a m-carboxyphenyl group), a hydroxy group (e.g., a p-hydroxyphenyl group, and a m-hydroxyphenyl group), an alkoxy group (e.g., a p-methoxyphenyl group, and a m-ethoxyphenyl group), a halogen atom (e.g., a p-chlorophenyl group, a p-bromophenyl group, and a p-fluorophenyl group), a cyano group (e.g., a p-cyanophenyl group, and an o-cyanophenyl group), a nitro group (e.g., a p-nitrophenyl group, and a m-nitrophenyl group), an amino group (e.g., a p-dimethylaminophenyl group, and a p-diethylaminophenyl group), or an alkyl group (e.g., a p-methylphenyl group, and an o-methylphenyl group)}, when $R_1$ and $R_2$ represent —$COOR_5$ and $R_5$ represents a hydrogen atom, $R_1$ and $R_2$ represent a carboxyl group that may form a salt (e.g., an Na salt, a K salt, an ammonium salt, and a quaternary ammonium salt), $R_5$ and $R_6$ may combine together to form a 5- or 6-membered ring (e.g., a morpholino group, pyrrolidino group and a piperidino group), $Q_1$ and $Q_2$, which may be the same or different, each represents an aryl group (e.g., a phenyl group, and a naphthyl group), or a substituted aryl group (e.g., a substituted phenyl group) {the substituent for the substituted aryl group may be an alkyl group having 1 to 4 carbon atoms, an alkoxy group having 1 to 4 carbon atoms, a halogen atom (e.g., a chlorine atom, a bromine atom, and a fluorine atom), a carbamoyl group (e.g., an ethylcarbamoyl group), a sulfamoyl group (e.g., an ethylsulfamoyl group), a cyano group, a nitro group, an alkylsulfonyl group (e.g., a methanesulfonyl group), an arylsulfonyl group (e.g., a benzenesulfonyl group), an amino group (e.g., a dimethylamino group), an acylamino group (e.g., an acetylamino group), or a sulfonamido group (e.g., a methanesulfonamido group)}, $X_1$ and $X_2$, which may be the same or different, each represents a divalent linking group or a bond, and more particularly each represents —0—,

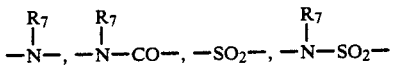

or a bond, $R_7$ represents a hydrogen atom, an alkyl group having up to 5 carbon atoms or a substituted alkyl group having up to 5 carbon atoms {the substituent may be an alkoxy group having up to 3 carbon atoms, a sulfo group (e.g., a sulfoethyl group, and a sulfopropyl group), a carboxyl group (e.g., a carboxyethyl group), a cyano group, a hydroxy group, an amino group (e.g., a hydroxyethyl group), a sulfonamido group (e.g., a methanesulfonamido group), a carbonamido group (e.g., an acetylamino group), a carbamoyl group (e.g., an ethylaminocarbonyl group), or a sulfamoyl group (e.g., an ethylaminosulfonyl group)}, $Y_1$ and $Y_2$, which may be the same or different, each represents a sulfo group or a carboxyl group that may form a salt (e.g., an Na salt, a K salt, an ammonium salt and a quaternary ammonium salt), $L_1$, $L_2$ and $L_3$, which may be the same or different, each represents a methine group or a substituted methine group (the substituent may be, for example, a methyl group, an ethyl group or a phenyl group), $m_1$ and $m_2$ each is 1 or 2, n is 0, 1 or 2, $p_1$ and $p_2$ each is 0, 1, 2, 3 or 4, and $s_1$ and $s_2$ each is 1 or 2.

Preferably, in the general formula (I), $R_3$ and $R_4$ each represents a hydrogen atom or a methyl group, $R_5$ and $R_6$ each represents a hydrogen atom, an alkyl group having up to 4 carbon atoms, a substituted alkyl group having up to 6 carbon atoms (the substituent is preferably a sulfo group, a carboxyl group, a hydroxyl group, an alkoxy group having up to 2 carbon atoms, a chlorine atom, a cyano group, an amino group or an alkylamino group having up to 4 carbon atoms), a phenyl group, or a substituted phenyl group (the substituent may be a sulfo group, a carboxyl group, an alkoxy group having up to 4 carbon atoms, a chlorine atom, a cyano group, an alkyl group having up to 4 carbon atoms, an amino group, or an alkylamino group having up to 4 carbon atoms), and $R_5$ and $R_6$ combine together to form a 5- or 6-membered ring (e.g., a morpholino ring, a pyrrolidine ring or a piperidine ring).

Preferably, $Q_1$ and $Q_2$ each represents a phenyl group or a substituted phenyl group {the substituent is preferably, for example, an alkyl group having up to 4 carbon atoms, an alkoxy group having up to 4 carbon atoms, a halogen atom (e.g., a chlorine atom, a bromine atom, and a fluorine atom), or a dialkylamino group having up to 4 carbon atoms}.

Preferably, $X_1$ and X2 each represents

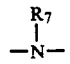

or a bond, wherein $R_7$ represents a hydrogen atom, an alkyl group having up to 5 carbon atoms or a substituted alkyl group having up to 5 carbon atoms (the substituent may be, for example, an alkoxy group having up to 3 carbon atoms, a cyano group, a hydroxy group, or an alkylamino group having up to 4 carbon atoms).

Of the dyes represented by general formula (I), dyes wherein $m_1=m_2=1$ are more preferable.

Structural differences between the known dyes and those of the present invention are briefly described hereinafter: The differences between the dyes of British Patent 1,466,836 and those of the present invention is that the former have a hydroxy group or alkoxy group in the 3-position of the pyrazolone nucleus, while the latter have an ester group, carboxylic acid group or carbamoyl group in the 3-position of the pyrazolone nucleus. The dyes of U.S. Pat. No. 3,746,536 have a phenyl group in the 1-position of the pyrazolone nucleus, while those of the present invention have an aralkyl group in the 1-position, and also a substituent in 3-position is quite different.

The dyes of U.S. Pat. No. 3,865,817 have an alkyl group having a sulfonic acid group or carboxylic acid group in the 1-position of the pyrazolone nucleus, while those of the present invention have an aralkyl group, The dyes of U.S. Pat. No. 3,989,528 have an ureido group, thioureido group, amido group or thioamido group in the 3-position of the pyrazolone nucleus, while those of the present invention have no such groups, the dyes of U.S. Pat. No. 4,067,738 have two kinds of heterocyclic rings including an oxazole ring and thus are quite different from the dyes of the present invention.

Specific examples of dyes represented by formula (I) used in the present invention are shown below, but the present invention is not limited to those dyes.

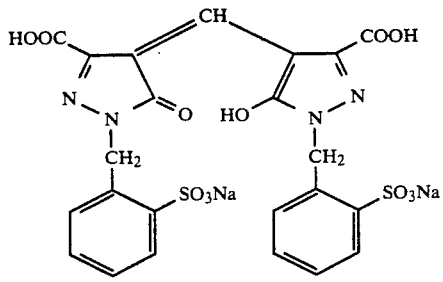

1

-continued
2
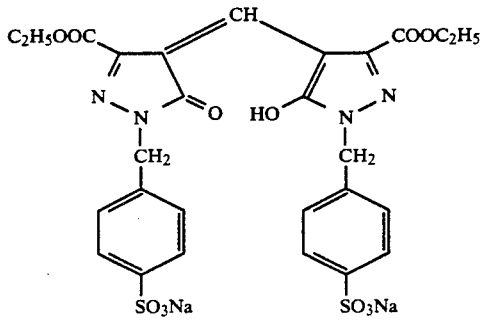
3
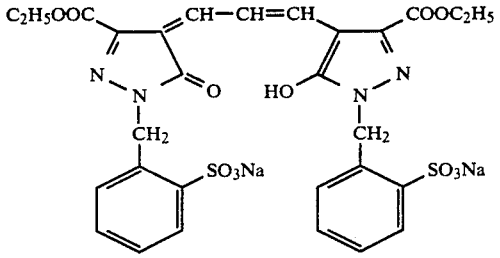
4
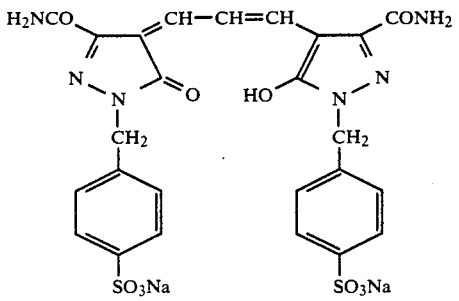
5
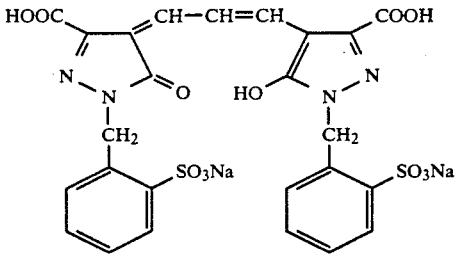
6
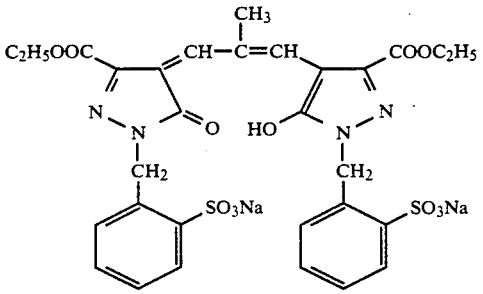

-continued
7
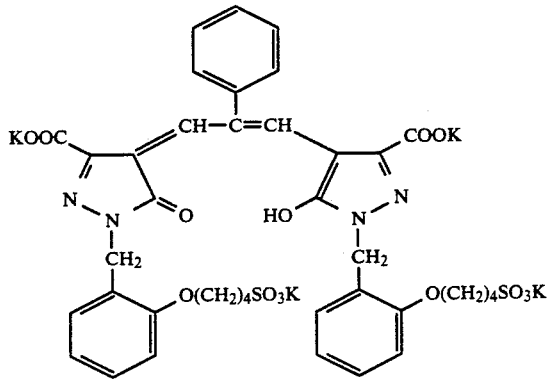
8
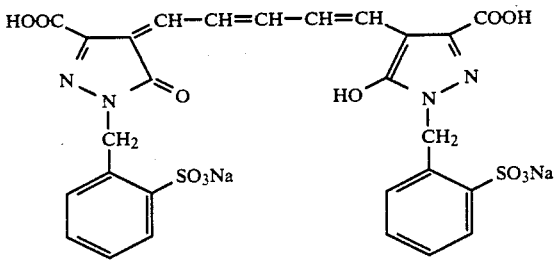
9
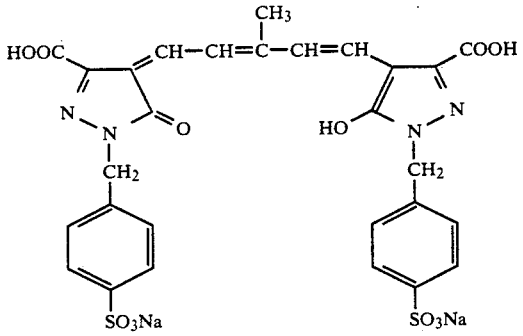
10
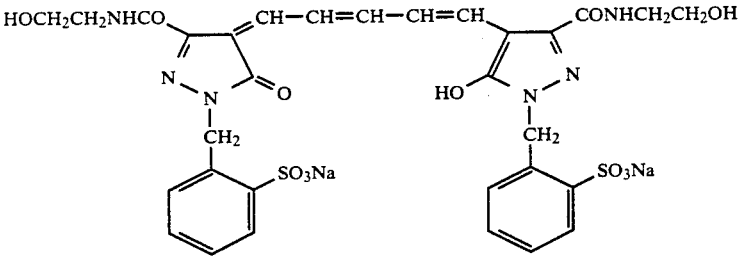
11
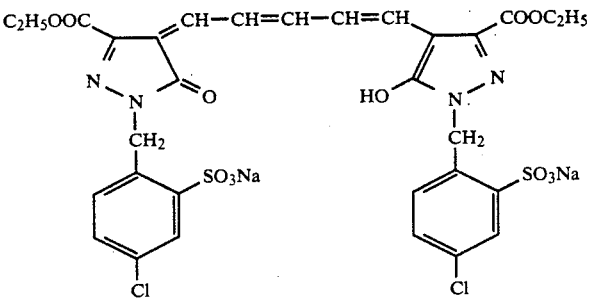

-continued
12
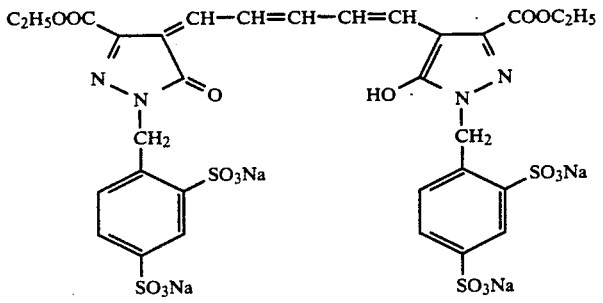
13
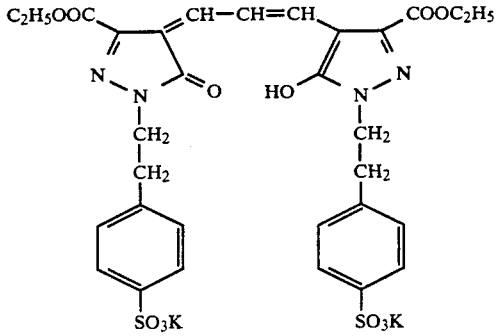
14
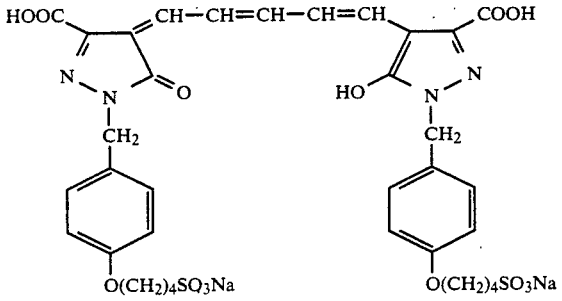
15
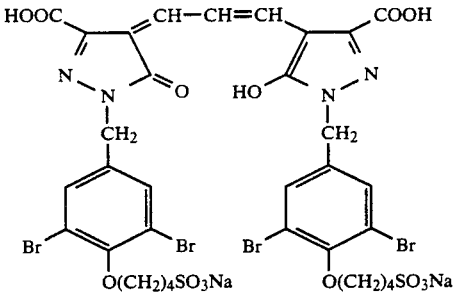
16
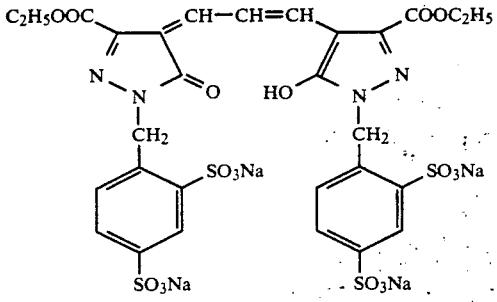

-continued
17
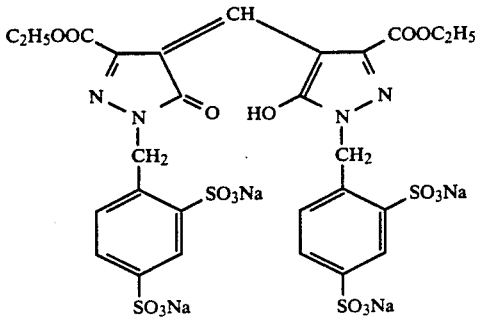
18
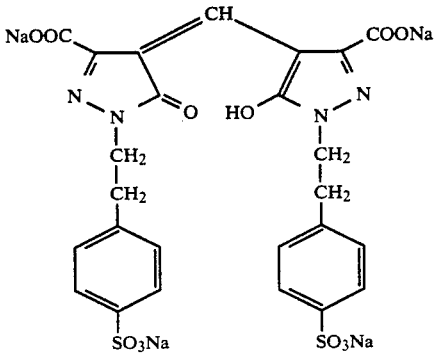
19
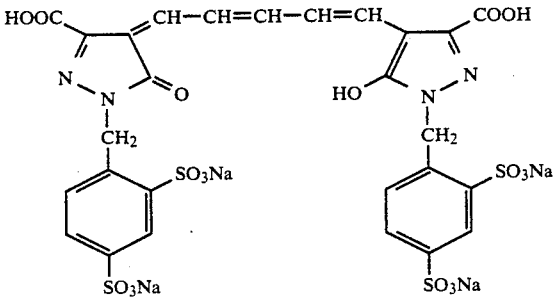
20
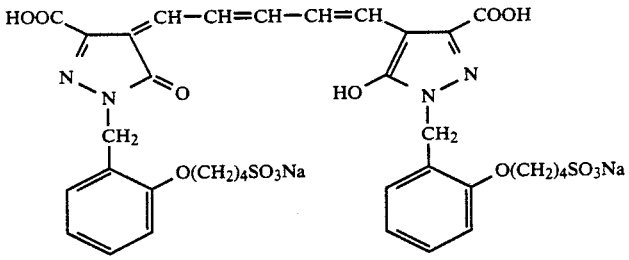
21
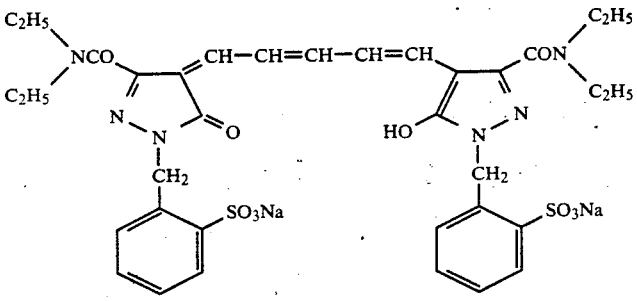

-continued
22
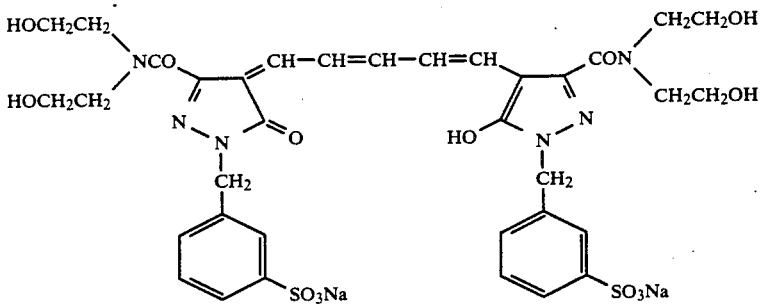
23
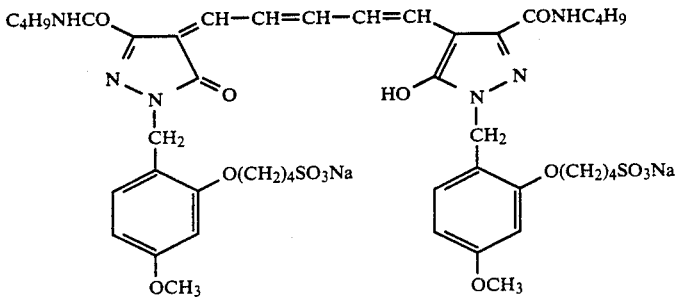
24
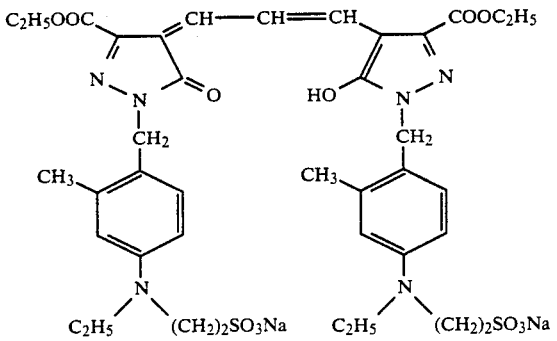
25
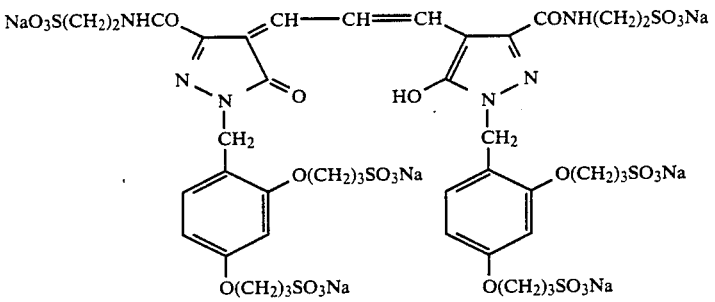
26
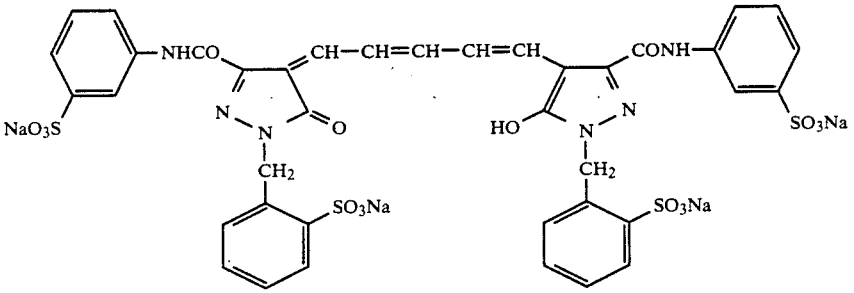

-continued
27
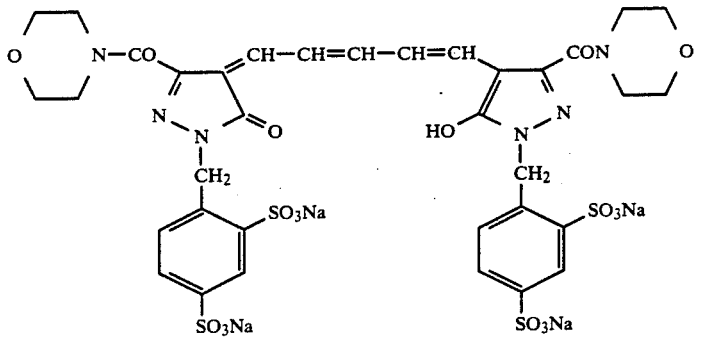
28
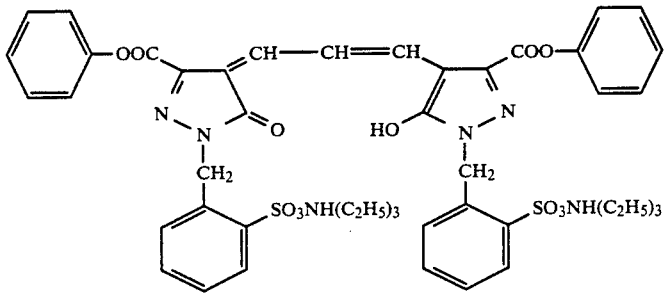
29
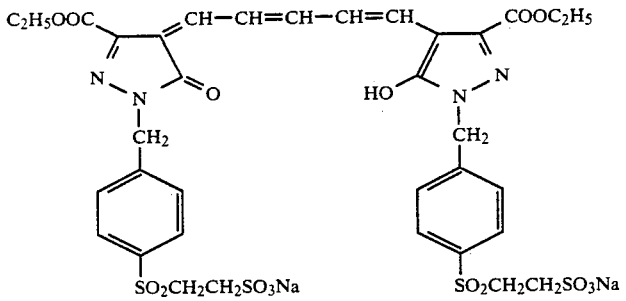
30
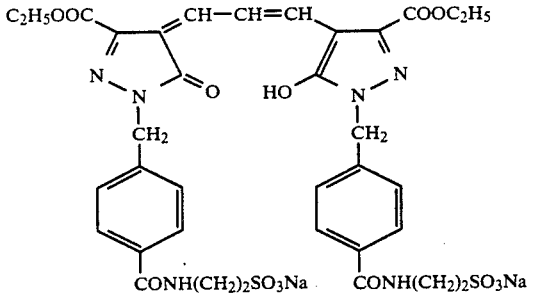
31
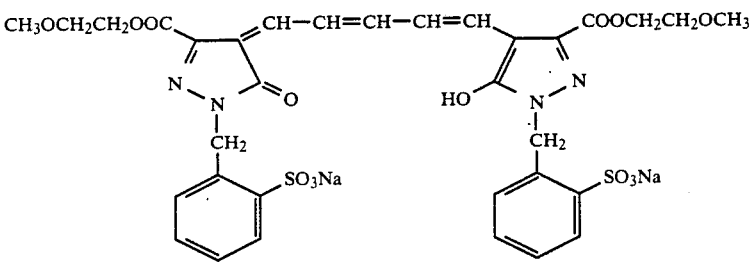

-continued
32
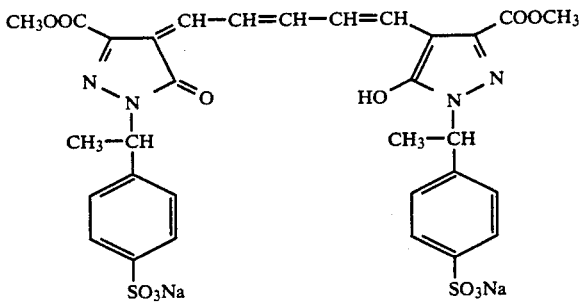
33
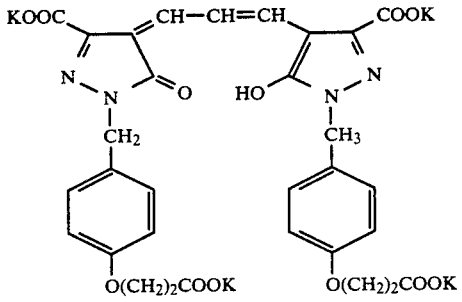
34
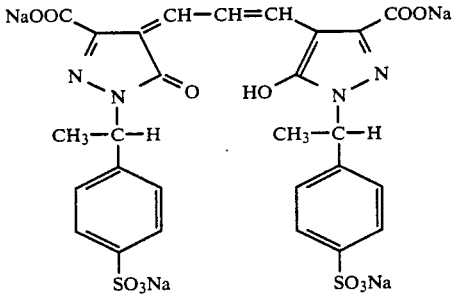
35
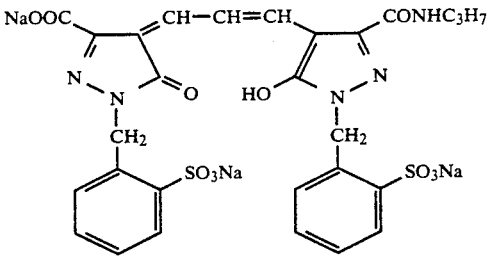
36
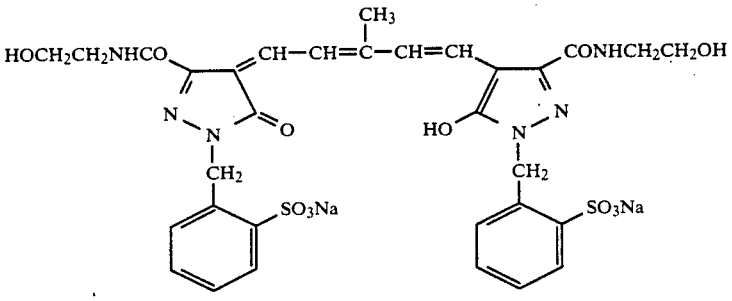

-continued
37
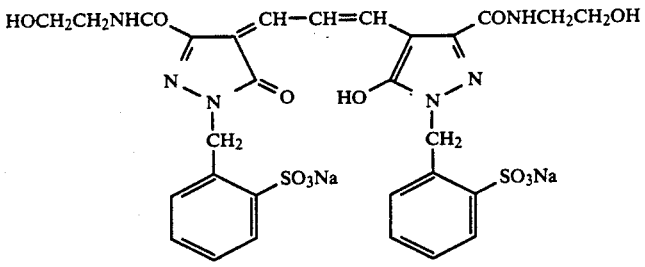
38
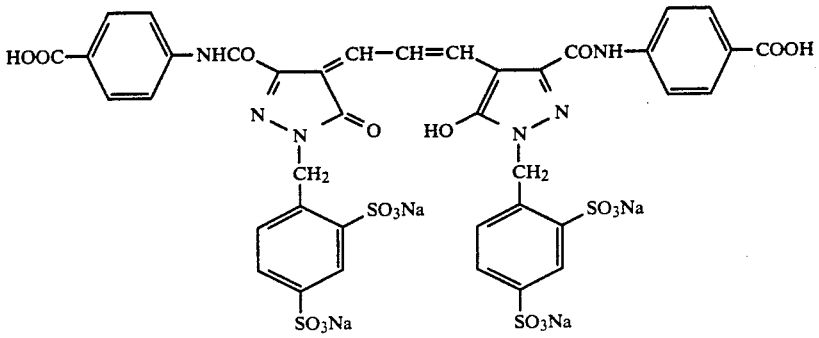
39
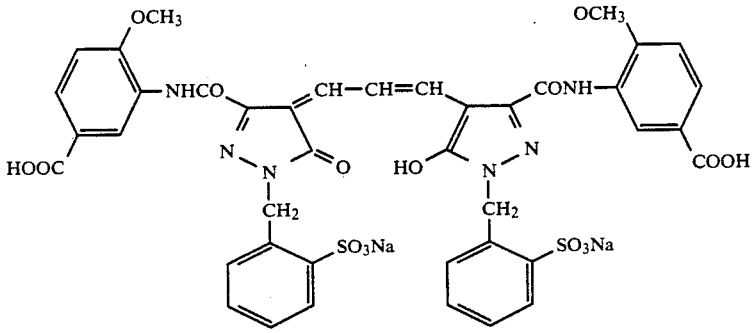
40
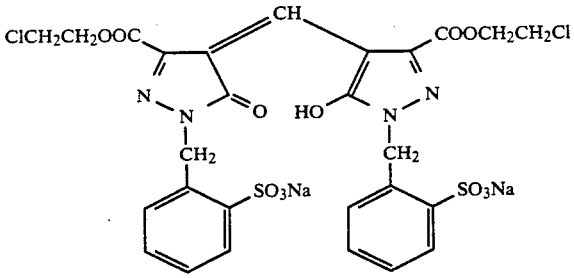
41
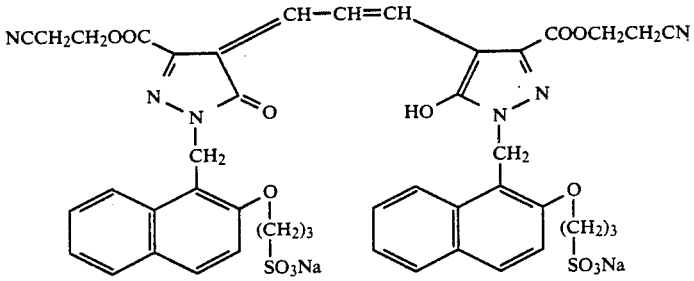

-continued
42
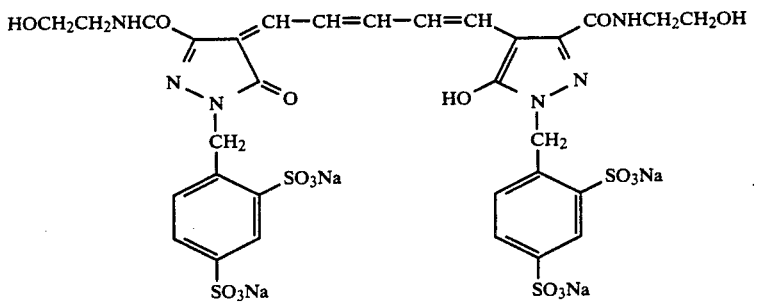
43
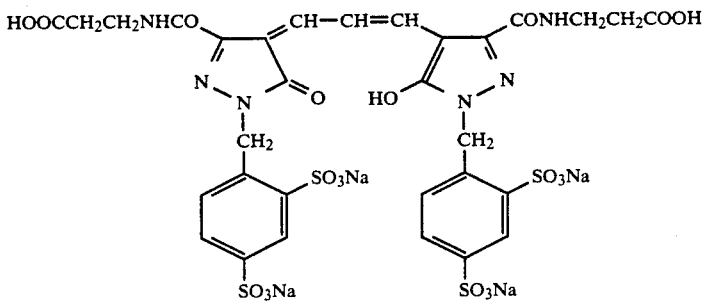
44
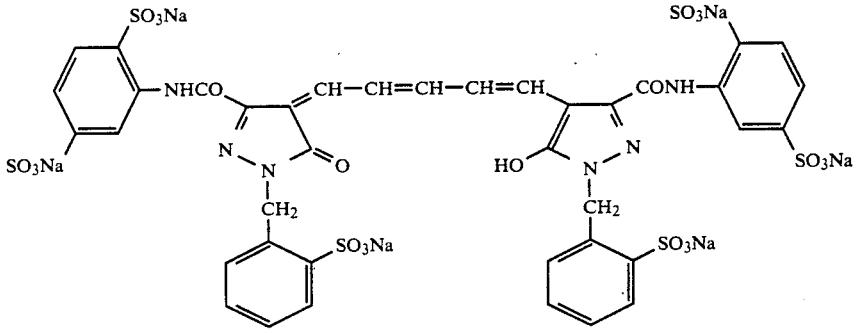
45
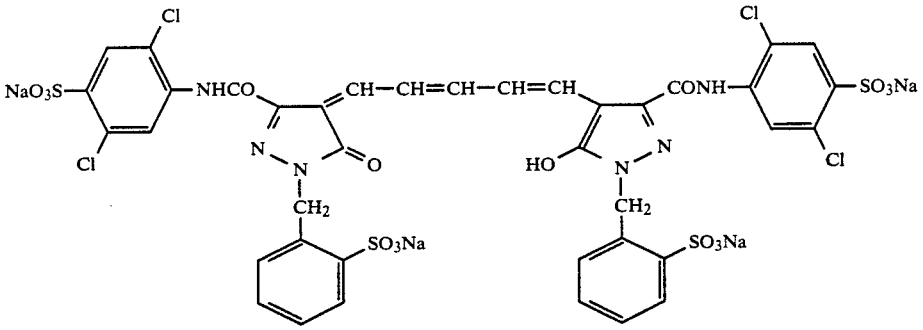
46
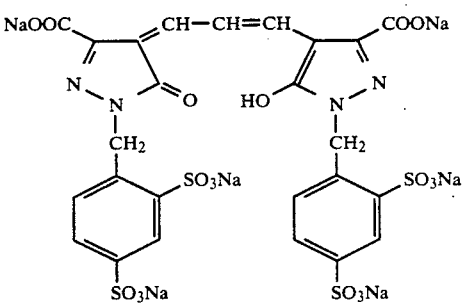

-continued
47
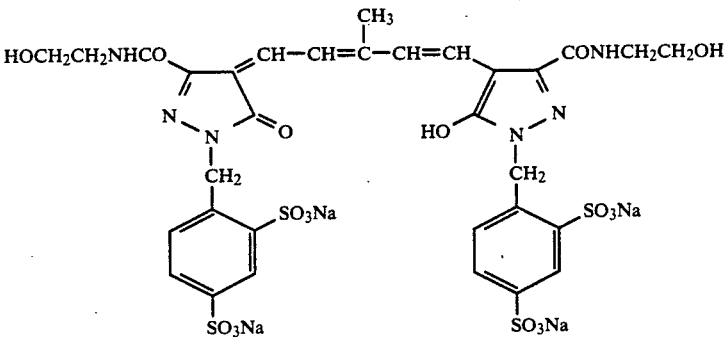
48
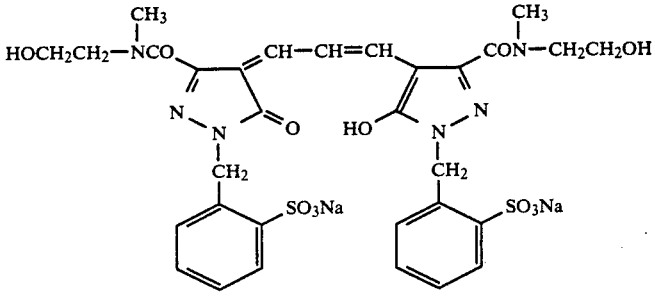
49
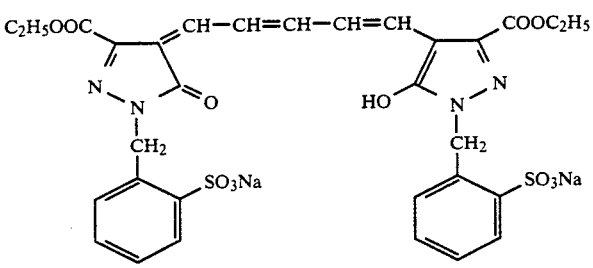
50
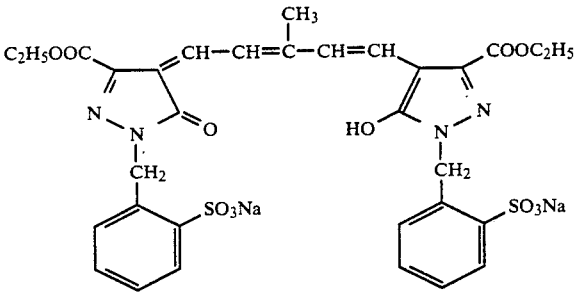
51
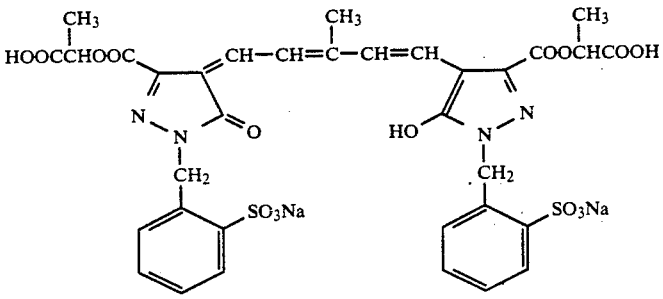
Compounds represented by the general formula (I) can be synthesized by various synthesizing methods, and for example can be synthesized by condensing a pyrazolone (II) with a compound represented by (IIIa), (IIIb), (IIIc), (IIId) or (IIIe) in the presence of a base. These formula are shown below:

(II)

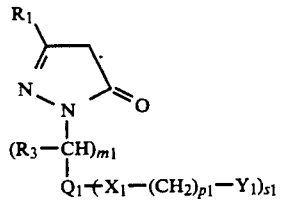

(IIIa)

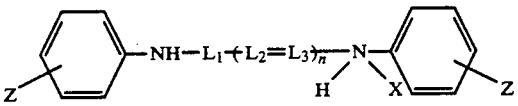

(IIIb)

$HC(OC_2H_5)_3$ (IIIc)

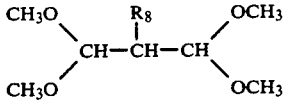

(IIId)

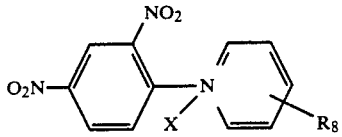

(IIIe)

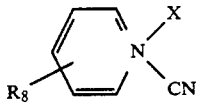

In the above formulae, $R_1$, $R_3$, $Q_1$, $X_1$, $Y_1$, $L_1$, $L_2$, $L_3$, $m_1$, n, $p_1$, and $s_1$ have the same meaning as given above, Z represents a hydrogen atom, a nitro group, or a halogen atom (e.g., a chlorine atom, and a bromine atom), $R_8$ represents a hydrogen atom, an alkyl group (e.g., a methyl group, and an ethyl group), or a phenyl group, and X represents an anion (e.g., a chloride ion, a bromide ion, an iodide ion, a perchlorate ion, a methylsulfate ion, an ethylsulfate ion, and a p-toluenesulfonate ion).

Typical examples of the base to be allowed to coexist in the condensing reaction are pyridine, piperidine, triethylamine, triethanolamine, sodium acetate, potassium acetate, etc.

Preferable solvents used in the condensing reaction are alcohols (e.g., methanol, ethanol, isopropanol), amides (e.g., dimethylformamide, dimethylacetamide, N-methylpyrrolidone), nitriles (e.g., acetonitrile), dimethyl sulfoxide, ethylene glycol, ethers (e.g., ethylene glycol, monomethyl ether, ethylene glycol diethyl ether), and water or a mixed solvent of water and the above organic solvent (volume ratio of water to the organic solvent is preferably 1: 1 to 1:100).

The reaction temperature can appropriately be selected from a temperature range of 0° to a boiling point of a solvent employed.

The reaction time is determined depending on the reaction temperature, and it can appropriately be selected from a range of 30 minutes to 3 days.

The pyrazolone (II) used in the condensing reaction can be used in a molar amount of about 0.1 to 3 times based on the compound represented by (IIIa), (IIIb), (IIIc), (IIId) or (IIIe).

Specific synthesis examples of dye compounds according to the present invention are illustrated below but the present invention is not limited to them.

SYNTHESIS EXAMPLE 1 (COMPOUND 3)

A solution of 104 g of sodium 2-formylbenzenesulfonate in 500 ml of methanol was added dropwise with stirring under cooling to 30 g of hydrazine hydrate. The reaction temperature rose from 25° C. to 35° C. and then the reaction mixture was allowed to stand overnight. To the reaction mixture was added 500 ml of isopropanol to precipitate white crystals. The crystals were filtered off, washed with 100 ml of isopropanol, and dried to obtain 63 g (Yield: 76%) of the sodium slat of 2-sulfobenzaldehyde hydrazone (A-1).

Melting point: at least 300° C.

A solution of 46 g of the above obtained (A-1) dissolved in 120 ml of ethanol and 60 ml of water was placed in a 500 ml-volume autoclave, wherein the reaction was carried out at 30° C. for 3 hours in the presence of 1 g of a palladium-carbon catalyst at a hydrogen pressure of 40 $Kg/cm^2$. The reaction mixture was cooled to room temperature, the catalyst was filtered off, and the solvent was distilled off under reduced pressure.

To the reaction solution was added 200 ml of ethanol to obtain 36 g of 2-sulfobenzyl hydrazine (A-20 as a white crystal.

Melting point: at least 300° C.

To 36 g of the crude (A-2) dispersed in 150 ml of acetic acid was added a solution of 36 g of sodium oxalacetate diethyl ester in ethanol to obtain an almost homogeneous solution. This reaction mixture was heated with stirring at 90° C. for 3 hours, and cooled to room temperature. 50 ml of ethanol-hydrochloric acid (adjusted to 36 wt% of hydrochloric acid by bubbling the hydrochloric acid into ethanol) was added to the reaction mixture to precipitate sodium chloride. After filtering off the sodium chloride, 500 ml of acetone was added to the solution to obtain 42.3 g (Yield: 78%) of 3-ethoxycarbonyl-1-(2-sulfobenzyl()pyrazolin-5-one (Intermediate A).

Melting point: 257° to 262° C.

5.2 g of 3-ethoxycarbonyl-1-(2-sulfobenzyl)-pyrazolin-5-one (Intermediate A) were added to 50 ml of ethanol, then 4.2 ml of triethylamine were added thereto, then 1.5 g of malonaldehydedianil hydrochloride was added thereto, and the mixture was heated for 3 hours under reflux to obtain a uniform solution. A solution of 1.2 g of sodium acetate in 15 ml of methanol was added to that hot solution with stirring. Then, when 25 ml of isopropanol were added thereto, dark purple crystals separated out. The crystals were filtered, then washed with isopropanol and dried to produce 2 g of Compound 3.

Melting point: at least 300° C.

$^{H}2O\lambda_{max}$ 551 nm $\epsilon 6.73\times10^4$

SYNTHESIS EXAMPLE 2 (COMPOUND 8)

To a solution of 7.8 g of sodium hydroxide in 20 ml of water was added 17.9 of the (Intermediate A) obtained in Synthesis Example 1 and the mixture was heated with stirring at 70° C. for 5 hours. After cooling the reaction mixture to room temperature, 16 ml of concentrated hydrdochloric acid was added to the reaction mixture. Then, such was concentrated under reduced pressure until white crystals began to precipitate. The mixtures was cooled with ice-cold water to precipitate the white crystals. The crystals were filtered off, washed with acetone and dried to obtain 14.2 g (Yield: 87%) of 3-carboxy-1-(2-sulfobenzyl)pyrazolin-5-one (Intermediate B).

Melting point: 223° to 226° C.

7.4 g of 3-carboxy-1-(2-sulfobenzyl)pyrazolin-5-one (Intermediate B), 50 ml of methanol and 7.5 ml of triethylamine were mixed and cooled with ice. 2.8 g of glutaconaldehydedianil hydrochloride were added to the mixture followed by stirring for 3 hours. Then when a solution of 4.2 g of sodium acetate in 50 ml of methanol was added and then 25 ml of isopropanol were added thereto, dark purple crystals separated out. The crystals were filtered, washed with isopropanol and dried to yield 5.4 g of Compound 8.

Melting point at least 300° C.

$^{H_2O}\lambda_{max}$ 626 nm $\epsilon 7.89\times10^4$

SYNTHESIS EXAMPLE 3 (COMPOUND 10)

A mixture of 14.5 g of (Intermediate A) and 5.3 g of ethanolamine was reacted under reduced pressure of 30 mmHg at 120° C. for 2 hours. The reaction mixture was cooled to room temperature and dissolved with an additional 30 ml of methanol. 300 ml of isopropanol was further added to the mixture to precipitate crystals. The crystals were filtered off, washed with isopropanol and dried to obtain 13 g (Yield: 86.5%) of 3-(2-hydroxyethylcarbamoyl)-1-(2-sulfobenzyl)pyrazolin-5-one.

Melting point: 215° to 219° C.

8 g of 3-(2-hydroxyethylcarbamoyl)-1-(2-sulfobenzyl)pyrazolin-5-one, 30 ml of methanol, and 3.8 ml of triethylamine were mixed and cooled 3 g of glutaconaldehydedianil hydrochloride were added to the solution, and then 2 ml of acetic anhydride were added thereto. After the mixture was reacted at room temperature for 1 hour, a solution of 4.3 g of sodium acetate in 50 ml of methanol was added, and then 20 ml of isopropanol were added thereto to precipitate black crystals. The crystals were filtered, washed with isopropanol, and dried to yield 6.1 g of Compound 10.

Melting point: at least 300° C.

$^{H_2O}\lambda_{max}$ 633 nm $\epsilon 8/8\times10^4$

SYNTHESIS EXAMPLE 4 (COMPOUND 18)

Using the method of Synthesis Example 1, except that phenylacetaldehyde was used in place of the sodium 2-formylbenzenesulfonate, 3-ethoxycarbonyl-2-(2-phenylethyl)pyrazolin-5-one was obtained. After hydrolysis using the method of Synthesis Example 2, 3-carboxyl-1-(2-phenylethyl)pyrazolin-5-one was obtained and this was sulfonated with concentrated sulfuric acid according to the usual method to obtain 3-carboxy-1-{2-(4-sulfophenyl)ethyl}pyrazolin-5-one.

6 g of 3-carboxy-1-{2-(4-sulfophenyl)ethyl}-pyrazolin-5-one, 50 ml of methanol and 7 ml of triethylamine were mixed, then 1.6 g of N,N'-diphenylformamidine hydrochloride were added thereto, and the mixture was heated for 2 hours to obtain a uniform solution. 50 ml of a methanol solution containing 4.5 g of sodium acetate were added to the solution, and then 20 ml of isopropanol were added thereto to precipitate yellow crystals. The crystals were filtered, washed with isopropanol, and dried to yield 4 g of Compound 18.

Melting point: at least 300° C.

$^{H_2O}\lambda_{max}$ 452 nm $\epsilon 2.10\times10^4$

SYNTHESIS EXAMPLE 5 (COMPOUND 12)

Using the method of Synthesis Example 1 except that disodium 2-formylbenzene-1,5-disulfonate was used in place of the sodium 2-formylbenzenesulfonate, 3-ethoxycarbonyl-1-(2,4-disulfobenzyl)-pyrazolin-5-one was obtained.

Synthesis Example 2 was repeated except that 3-ethoxyoarbonyl-1-(2,4-disulfobenzyl)pyrazolin-5-one was used to produce Compound 12.

Melting point: at least 300° C.

$^{H_2O}\lambda_{max}$ 640 nm $\epsilon 7.02\times10^4$

SYNTHESIS EXAMPLE 6 (COMPOUND 20)

The 3-ethoxycarbonyl-1-(2,4-disulfobenzyl)pyrazolin-5-one was hydrolyzed using the method of Synthesis Example 2 to obtain 3-carboxy-1-{2-(4-sulfobutyloxy)-benzyl}pyrazolin-5-one.

Synthesis Example 2 was repeated except that 3-carboxy-1-{2-(4-sulfobutyloxy)benzyl]pyrazolin-5-one to produce Compound 20.

Melting point: 264° to 269° C. (decomposed)

$^{H_2O}\lambda_{max}$ 628 nm $\epsilon 7.39\times10^4$

The amount of dye represented by general formula (I) employed is not critical to the present invention, but is preferably in the range of 2 mg/m$^2$ to 40 mg/m$^2$. An amount of 2 mg/m$^2$ or less can prevent irradiation, but deterioration in sharpness becomes marked, while when using an amount of 40 mg/m$^2$ or more effects an insufficient discoloring, particularly, in rapid processing and also causes color stain. The addition may be carried out in any stage before coating on the support is carried out.

The dyes for use in the present invention can be dispersed in emulsion layers and other hydrophilic colloid layers (e.g., an intermediate layer, a protective layer, an antihalation layer, or a filter layer) by using different known methods.

(1) The dyes for use in the present invention can be directly dissolved or dispersed in an emulsion layer or a hydrophilic colloid layer, or can be dissolved or dispersed in an aqueous solution or a solvent and then added to an emulsion layer or a hydrophilic colloid layer. For example, a solution of the dye for use in the present invention dissolved in a suitable solvent such as methyl alcohol, ethyl alcohol, propyl alcohol, methyl cellosolve, pyridine, water, acetone, or halogenated alcohols described in Japanese Patent Application (OPI) No. 9715/73 and U.S. Pat. No. 3,756,830, or a mixture of these solvents may be added to an emulsion layer of hydrophilic colloid layer.

(2) As a mordant, a hydrophilic polymer having a charge opposite to the dye ion is allowed to be present in a layer, and the added dye is localized in that particular layer due to the interaction between the polymer and the dye molecules.

Suitable polymer mordants include, for example, polymers containing secondary and tertiary amino groups, polymers having nitrogen-containing heterocyclic moieties, and polymers containing quaternary cation groups derived from the above-described polymers, which polymers have a molecular weight of at least about 5,000, more preferably at least 10,000.

Examples of such polymers are vinylpyridine polymers and vinylpyridinium cation polymers described, for example, in U.S. Pat. No. 2,548,564; vinylimidazolium cation polymers described, for example, in U.S. Patent 4,124,386; polymer mordants cross-linkable with gelatin or the like disclosed, for example, in U.S. Pat. No. 3,625,694; aqueous sol type mordants disclosed, for example, in U.S. Pat. Nos. 3,958,995 and Japanese Patent Application (OPI) No. 115228/79; water-insoluble mordants disclosed, for example, in U.S. Pat. No. 3,898,088; reactive mordants capable of covalently combining with dyes disclosed, for example, in U.S. Pat. No. 4,168,976; polymers derived from ethylenically unsaturated compounds having a dialkylaminoalkyl ester residue as described in British Patent No. 685,475; products obtained by reaction of polyvinylalkylketones with aminoguanidine as described in British Patent No. 850,281; and polymers derived from 2-methyl-1-vinylimidazole as described in U.S. Pat. No. 3,445,231.

(3) The dyes as used in the present invention can be dissolved using a surface active agent.

Useful surface active agents may be oligomers or polymers. A detailed description of such polymers is in Japanese Patent Application (OPI) No. 158437/85 (filed by Fuji Photo Film Co., Ltd. on Jan. 26, 1984), pages 19 to 27.

A hydrosol of lipophilic polymers described in Japanese Patent Publication No. 39835/76 may be added to the above hydrophilic colloid dispersion, it desired.

Although gelatin can be mentioned as a typical hydrophilic colloid, any other known hydrophilic colloids that can be used for photography can be used in the present invention.

Silver halides used in the present invention are preferably silver bromide, silver bromoiodide, silver bromochloroiodide, silver chlorobromide and silver chloride.

The silver halide grains may have a regular crystal form such as a cubic form or an octahedral form, or an irregular crystal form such as a spherical form or a tabular form, or may comprise a composite form thereof. Although it is possible to use a mixture of grains having different crystal forms, it is preferable to use grains having a regular crystal form.

Silver halide grains used in the present invention may have a phase wherein the internal phase is different from the surface phase, or they may have a uniform phase. The grains may form a latent image mainly on the surfaces thereof (e.g., a negative type emulsion), or may form a latent image mainly in the internal portion of the grains (e.g., an. internal latent image type emulsion and a previously fogged direct reversal type emulsion). Grains wherein a latent image is formed mainly on the surfaces of the grains are preferable.

It is preferable that the silver halide emulsion used in the present invention is a tabular grain emulsion wherein grains having a thickness of up to about 0.5 micron, preferably up to 0.3 micron, a diameter of at least 0.6 micron, and an average aspect ratio of at least about 5 occupy approximately 50% or more of the total projected area, or a monodispersed emulsion wherein the statistical variation coefficient (the value $S/\bar{d}$ obtained by dividing the standard deviation S by the diameter $\bar{d}$ when the projected area is nearly round is up to about 20%. Two or more of tabular grain emulsions and monodispersed emulsions may be admixed, it desired.

The photographic emulsions used in the present invention may be prepared by methods described, for example, by P. Glafkides in *Chimie et Physique photographique*, Paul Montel, (1967), by G. F. Duffin in *Photographic Emulsion Chemistry*, Focal Press, (1966), and by V. L. Zelikman et al. in *Making and Coating Photographic Emulsion*, Focal Press, (1964).

When the silver halide grains are formed, in order to control the growth of the grains, a silver halide solvent such as ammonia, potassium rhodanate, ammonium rhodanate, thioether compounds (e.g., those described in U.S. Pat. Nos. 3,271,157, 3,574,628, 3,704,130, 4,297,439 and 4,276,374), thion compounds (e.g., those described in Japanese Patent Application (OPI) Nos. 144319/78, 82408/78 and 77737/80) and amine compounds (e.g., those described in Japanese Patent Application (OPI) No. 100717/79) may be used.

In the process of formation or physical ripening of the silver halide grains, for example, a cadmiun salt, a zinc salt, a thallium salt, an iridium salt or its complex salt, a rhodium salt or its complex salt, or an iron salt or its iron complex salt may also be present.

The silver halide emulsion is usually chemically sensitized. To perform chemical sensitization, for example, the methods described by H. Frieser in *Die Grundlagender Photographischen Prozesse mit Silberhalogeniden*, [Akademische Verlagagesellschaft, (1968)], pages 675 to 734, can be employed.

The is, sulfur sensitization using active gelatin or a compound containing sulfur capable of reacting with silver (e.g., thiosulfates, thioureas, mercapto compounds and rhodanines); reduction sensitization using a reducing substance (e.g., stannous salts, amines, hydrazine derivatives, formamidine sulfinic acid, and silane compounds); and noble metal sensitization using a noble metal compound (e.g., gold complex compounds and complex salts of metals of Group VIII of the Periodic Table such as Pt, Ir and Pd) can be used alone or in combination.

The silver halide photographic emulsion(s), used in the present invention may contain various compounds in order to prevent fogging during the preparation process, storage, or photographic processing of the photographic material or in order to stabilize the photographic performance. That is, many compounds known as antifoggants or stabilizers, such as azoles, for example, benzothiazolium salts, nitroindazoles, triazoles, benzotriazoles, benzimidazoles (particularly nitro- or halogensubstituted benzimidazoles); heterocyclic mercapto compounds such as mercaptothiazoles, mercaptobenzthiazoles, mercaptobenzimidazoles, mercaptothiadiazoles, mercaptotetrazoles (particularly 1-phenyl-5-mercaptotetrazole), and mercaptopyrimidines; heterocyclic mercapto compounds having a water-soluble group such as a carboxyl group or a sulfon group; thioketo compounds such as oxazolinthione; azaindenes such as tetraazaindenes (particularly 4-hydroxy-substituted (1,3,3a,7)tetraazaindenes); benzenethiosulfonic acid, and benzenesulfinic acid.

The silver halide photographic emulsion(s), useful in the present invention can contain compounds for dispersing couplers and color couplers such as cyan coupler, magenta couplers and yellow couplers.

That is, compounds capable of forming colors by oxidation coupling with aromatic primary amine developers (e.g. phenylenediamine derivatives and aminophenol derivatives) in the color development process can be present. Examples of magenta couplers are 5-pyrazolone couplers, pyrazolobenzimidazole couplers, cyanoacetylcumarone couplers, pyrazolotriazole couplers, and openchain acylacetonitrile couplers; examples of yellow couplers include, for example, acylacetoamide couplers (e.g., benzoylacetoanilides and pivaloylacetoanilides); and examples of cyan couplers include naphthol couplers and phenol couplers. Of these couplers, nondiffusible couplers having a hydrophobic group called a ballast group in the molecule are desirable. The couplers may be 4equivalent or 2-equivalent to a silver ion. Colored couplers having a color correction effect or couplers capable of releasing a development inhibitor upon development (so-called DIR couplers) may be also used.

Besides DIR couplers, colorless DIR coupling compounds, the product of the coupling reaction of which is colorless and which will release a development inhibitor, can also be present.

To increase the sensitivity or the contrast or to facilitate development, the photographic emulsion(s) of the present invention may contain, for example, polyalkylene oxides or their derivatives such as their ethers, esters and amines, thioether compounds, thiomorpholines, quaternary ammonium salt compounds, urethane derivatives, urea derivatives, imidazole derivatives and 3-pyrazolidones.

For the purpose of preventing irradiation, as filter dyes or for other purposes, the silver halide photographic emulsion(s) of the present invention may contain, in addition to the dyes for use in the present invention, known water-soluble dyes (e.g., oxonol dyes, hemioxonol dyes and merocyanine dyes). Besides the dyes for use in the present invention, known cyanine dyes, merocyanine dyes and hemicyanine dyes can be used as spectral sensitizers.

The photographic emulsion(s) of the present invention may contain various surface active agents as coating aids or for various purposes, for example, for antistatic purposes, for the purpose of improving slipperiness, for the purpose of emulsifying and dispersing, for the purpose of preventing adhesion and for the purpose of improving photographic performances (e.g., the facilitation of development, high contrast and sensitization).

The photosensitive material of the present invention may also contain fading preventive agents, hardening agents, color fogging preventive agents, ultraviolet absorbers, protective colloids such as gelatin, and other additives, which are described, for example, in detail in *Reserch Disclosure*, No. 17643, Vol. 176 (Dec., 1978, XII) (RD-17643).

The finished emulsion is applied to a suitable support such as baryta paper, resin-coated paper, synthetic paper, triacetate film, polyethylene terephthalate film, other plastic bases or a glass plate.

The silver halide photographic material containing dyes of the present invention can be used, for example, for color positive films, color papers, color negative films, color reversal films (that may or may not contain couplers), photosensitive materials for photomechanical process (e.g., lith films, and lith duplicating films), photosensitive materials for cathode ray tube display (e.g., emulsion X-ray recording photographic materials and materials for direct and indirect photography using a screen), photosensitive materials for silver salt diffusion transfer processes, photosensitive materials for color diffusion transfer processes, photosensitive materials for inhibition transfer processes, photosensitive materials used in silver dye bleaching methods, photosensitive materials for recording print-out images, photosensitive materials for direct print images, photosensitive materials for heat development, and photosensitive materials for physical development.

Exposure of the material to obtain a photographic image may be effected in a conventional manner. That is, any of various known light sources such as natural light (sunlight), a tungsten lamp, a fluorenscent lamp, a mercury lamp, a xenon-arc lamp, a carbon-arc lamp, a xenon-flash lamp, and a cathode ray tube flying spot can be used. Exposure time may be from 1/1000 sec to 30 sec, or may be shorter than 1/1000 sec, and, for example, an exposure period of $1/10^4$ to $1/10^6$ sec using a xenon-flash lamp, or a cathode ray tube is possible or an exposure period longer than 30 sec can be used, as necessary. The spectral composition of light used for exposure can be adjusted, if required, by using a color filter. A laser beam can also be used for the exposure. Moreover, exposure may be effected by light released from a phosphor excited by an electron ray, an X-ray, a λ-ray, an α-ray or the like.

For the photographic processing of photographic materials according to the present invention, any of the known methods and the known processing solutions described, for example, in *Reserch Disclosure*, No. 17643, pages 28 to 30 (RD-17643) (Dec. 1978) can be utilized. This photographic processing may be photographic processing for forming silver images (black-and-white photographic processing) or photographic processing for forming dye images (color photographic processing) according .to the desired purpose or use. The processing temperature is usually selected between 18° to 50° C., but the processing temperature may be below 18° C. or over 50° C., it necessary.

There is no limitation on the method of color photographic processing, and any suitable method can be applied. For example, a typical method includes the steps exposure, color development, and bleach-fixing, followed (if required) by washing and stabilizing. Another method employs the steps of exposure, color development, bleaching and fixing, followed (if required) by washing, and stabilizing. Also, a method wherein after exposure, development using a developing solution containing a black-and-white developing agent is effected, uniform exposure is provided, and then color development and bleach-fixing are effected, followed (if required) by washing and stabilizing. Still another typical method is one wherein after exposure, development using a developing solution containing a black-and-white developing agent is effected, and further development using a color developing solution containing a fogging agent (e.g. sodium boron hydride) is effected, followed (if required) by washing and stabilizing.

The aromatic primary amine type color developing agent used in the color developing solution in the present invention includes known aromatic primary amine type color developing agents used widely in various color photographic processes. These developing agents include aminophenol type and p-phenylenediamine type derivatives. Preferred examples are p-phenylenediamine derivatives, and typical examples thereof are given below, which do not limit the present invention:

D-1: N,N-diethyl-p-phenylenediamine
D-2: 2-amino-5-diethylaminotoluene
D-3: 2-amino-5-(N-ethyl-N-laurylamino)toluene
D-4: 4-[N-ethyl-N-(8-hydroxylethyl)amino]aniline
D-5: 2-methyl-4-[N-ethyl-N-(8-hydroxyethyl-)amino]aniline
D-6: N-ethyl-N-(8-methanesulfonamidoethyl)-3-methyl4-aminoaniline
D-7: N-(2-amino-5-diethylaminophenylethyl)methanesulfonamide,
D-8: N,N-dimethyl-p-phenylenediamine
D-9: 4-amino-3-methyl-N-ethyl-N-methoxyethylaniline
D-10 4-amino-3-methyl-N-ethyl-N-8-ethoxyethylaniline
D-11: 4-amino-3-methyl-N-ethyl-N-8-butoxyethylaniline These p-phenylenediamine derivatives may be in the form of salts such as sulfates, hydrochlorides, sulfites and p-toluenesulfonates. The above compounds are described, for example, in U.S. Pat. Nos. 2,193,015, 2,552,241, 2,566,271, 2,592,364, 3,656,950, and 3,698,525. The amount of the aromatic primary amine color developing agent to be used is preferably about 0.1 g to about 20 g, more preferably about 0.5 g to about 10 g, per liter of a developing solution.

The color developing solution used in the present invention can contain hydroxylamines as is known in the art.

Although hydroxylamines can be used in the form of a free amine in the color developing solution, it is more common that they are used in the form of a water-soluble acid salt. Common examples of such salts are sulfates, oxalates, chlorides, phosphates, carbonates, acetates, etc. Hydroxylamines may be or may not be substituted, and the nitrogen atom of hydroxylamines may be substituted by an alkyl group.

The amount of a hydroxylamine to be added is preferably 0 to 10 g, more preferably 0 to 5 g, per liter of a color developing solution As long as the stability of a color developing solution is maintained, a smaller amount is preferable.

It is preferably that, as a preservative, a sulfite such as sodium sulfite, potassium sulfite, sodium bisulfite, potassium bisulfite, sodium metasulfite and potassium metasulfite, or a carbonyl sulfite adduct is contained. The amount of preservative to be added to a color developing solution is 0 g to about 20 g/liter, preferably 0 g to 5 g/liter, and if the stability of a color developing solution is secured, a smaller amount is preferred.

Other suitable preservatives include aromatic polyhydroxy compounds described in Japanese Patent Application (OPI) Nos. 49828/77, 47038/81, 32140/81, and 160142/84 and U.S. Pat. No. 3,746,544; hydroxyacetones described in U.S. Pat. No. 3,615,503 and British Patent No. 1,306,176; α-aminocarbonyl compounds described in Japanese Patent Application (OPI) Nos. 143020/77 and 89425/78; metals described in Japanese Patent Application (OPI) Nos. 44148/82 and 53749/82, sugars described in Japanese Patent Application (OPI) No. 102727/77; hydroxamic acids described in Japanese Patent Application (OPI) No. 27638/77; α,α'-dicarbonyl compounds described in Japanese Patent Application (OPI) No. 160141/84; salicylic acids described in Japanese Patent Application (OPI) No. 180588/84; alkanolamines described in Japanese Patent Application (OPI) No. 3532/78; poly(alkyleneimine)s described in Japanese Patent Application (OPI) No. 94349/81; and gluconic acid derivatives described in Japanese Patent Application (OPI) No. 75647/81, and two or more of these can be combined, if required. In particular, addition of 4,5-dihydroxy-m-benzenedisulfonic acid, poly(ethyleneimine), triethanolamine, or the like is preferable.

Preferably, the pH of the color developing solution used in the present invention is 9 to 12, more preferably 9 to 11.0, and other known compounds that are usual components of developing solutions can be added to the color developing solution.

To maintain the above pH, preferably, various buffers are used. Buffers include carbonates, phosphates, borates, tetraborates, hydroxybenzoates, glycine salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts and lysine salts. In particular, carbonates, phosphates, tetraborates and hydroxybenzoates are excellent in solubility and buffer performance in a high pH range of at least pH 9.0, and when they are added to the color developing solution, advantageously there are not adverse effects (e.g., fogging) on photographic performance, and they are inexpensive, so that it is particularly preferable to use these buffers.

Specific examples of these buffers are sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate). However, the present invention is not limited to these compounds.

Preferably, the amount of the buffer to be added to the color developing solution is about 0.1 mol/liter or more, more preferably 0.1 mol/liter to 0.4 mol/liter.

Various chelating agents can be used in the color developing solution which serve as suspension agents for calcium and magnesium or to improve the stability of the color developing solution.

Suitable chelating agents preferably include organic compounds such as aminopolycarboxylic acids described in Japanese Patent Publication Nos. 30496/73 and 30232/69, organic phosphonic acids described in Japanese Patent Application (OPI) No. 97347/81, Japanese Patent Publication No. 39359/81 and West German Patent No. 2,227,639, phosphonocarboxylic acids described, for example, in Japanese Patent Application (OPI) Nos. 102726/77, 42730/78, 121127/79, 126241/80 and 65956/80 and compounds described, for example, in Japanese Patent Application (OPI) Nos. 195845/83 and 203440/83 and Japanese Patent Publication No. 40900/78. Specific examples are given below, but the present invention is not limited thereto:

nitrilotriacetic acid,
diethyleneaminepentaacetic acid,
ethylenediaminetetraacetic acid,
triethylenetetraminehexaacetic acid,
N,N,N-trimethylenephosphonic acid,
ethylenediamine-N,N,N',N'-tetramethylenephosphonio acid,
1,3-diamino-2-propanol-tetraacetic acid,
transcyclohexanediaminetetraacetic acid,
nitrilotripropionic acid,
1,2-diaminopropanetetraacetic acid,
hydroxyethyliminodiacetic acid,
glycol ether diaminetetraacetic acid,
hydroxyethylenediaminetriacetatic acid,
ethylenediamineorthohydroxyphenylacetic acid,
2-phosphonobutane-1,2,4-tricarboxylic acid,
1-hydroxyethane-1,1-diphosphonic acid and
N,N'-bis(2-hydroxybenzyl)ethylenediamine-N,N'-diacetic acid.

Two or more of these chelating agents may be combined, if required.

The amount of these chelating agents to be added should be enough to sequester the metal ions in the color developing solution, for example, on the order of 0.1 to 10 g per liter.

If required, a development accelerator, which is not particularly limited, may be added to the color developing solution.

Suitable development accelerators include benzyl alcohol, as well as thioether type compounds disclosed, for example, in Japanese Patent Publication Nos. 16088/62, 5987/62, 7826/63, 12380/69 and 9019/70 and U.S. Pat. No. 3,813,247; p-phenylenediamine type compounds disclosed in Japanese Patent Application (OPI) Nos. 49829/77 and 15554/75, quaternary ammonium salts disclosed, for example, in Japanese Patent Application (OPI) No 137726/75, Japanese Patent Publication No. 30074/69 and Japanese Patent Application (OPI) Nos. 156826/81 and 43429/77; p-aminophenols described in U.S. Pat. Nos. 2,610,122 and 4,119,462; amine type compounds described, for example, in U.S. Pat. Nos. 2,494,903, 3,128,182, 4,230,796 and 3,253,919, Japanese Patent Publication No. 11431/66 and U.S. Pat. Nos. 2,482,546, 2,596,926 and 3,582,346; polyalkylene oxides disclosed, for example, in Japanese Patent Publication Nos. 16088/62 and 25201/67, U.S. Pat. No. 3,128,183, Japanese Patent Publication Nos. 11431/66 and 23883/67 and U S. Pat. No. 3,532,501, as well as 1-phenyl-3-pyrazolidones, hydrazines meso-ionic type compounds, thionic type compounds and imidazoles, which are added if required. Particularly, thioether type compounds and 1-phenyl-3-hydrozolidones are preferable.

Various antifoggants may be added to the color development solution for use in the present invention, if required. Suitable antifoggants preferably include alkali metal halides such as potassium iodide, sodium bromide, and potassium iodide as well as organic antifoggants. Organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, and 2-thiazolylmethylbenzimidazole, mercapto-substituted heterocyclic compounds such as 2mercaptobenzimidazole, and 2-mercaptobenzothiazole, adenine and mercapto-substituted aromatic compounds such as thiosalicylic acid. Although these antifoggants may dissolve out from the silver halide color photographic material while it is being processed and thus accumulate in the color developing solution, it is preferable that the amount of accumulation is relatively low in view of reduction of the amount of discharge.

Preferably, the present color developing solution also contains a brightening agent. Preferred brightening agents are 4,4'-diamino-2,2'-disulfostilbene type compounds. The amount of brightening agent to be added is 0 to 5 g/liter, preferably 0.1 to 2 g/liter.

If required, surface active agents such as alkyl phosphonic acids, aryl phosphonic acids, aliphatic carboxylic acids and aromatic carboxylic acids may also be added to the developing solution.

The processing temperature of the color developing solution for use in the present invention is from about 30° to about 50° C., preferably 33° to 42° C. It is preferable that the replenishing amount is 30 to 2000 ml, preferably 30 to 1500 ml, per $m^2$ of the photosensitive material. Smaller replenishing amounts are desirable in view of the reduction of waste solutions.

Bleaching agents in a bleaching solution or a bleach-fixing solution used in the present invention are usually ferric complex salts. Ferric complex salts are complexes of a ferric ion with chelate agents such as aminopolycarboxylic acids, aminopolyphosphonic acids or their salts. Aminopolycarboxylates or aminopolyphosphonates are salts of alkali metals, ammonium or water-soluble amines with aminopolycarboxylic acids or aminopolyphosphonic acids. Alkali metals include sodium, potassium, lithium, etc. and water-soluble amines include alkylamines such as methylamine, diethylamine, triethylamine, and butylamine, aliphatic amines such as alkylamines and cyclohexylamines, arylamines such as m-toluidine and aniline, and heterocyclic amines such as pyridine, morpholine and piperidine.

Typical examples of chelate agents such as these aminopolycarboxylic acids and aminopolyphosphonic acids and their salts are given below, but the present invention is not limited to these exemplified compounds:

ethylenediaminetetraacetic acid,
disodium ethylenediaminetetraacetate,
diammonium ethylenediaminetetraacetate,
tetra(trimethylammonium)ethylenediaminetetraacetate,
tetrapotassium ethylenediaminetetraacetate,
tetrasodium ethylenediaminetetraacetate,
trisodium ethylenediaminetatraacetate,
diethylenetriaminepentaacetic acid,
pentasodium diethylenetriaminepentaacetate,
ethylenediamine-N-(β-oxyethyl)-N,N',N'-triacetic acid,
trisodium ethylenediamine-N-(β-oxyethyl)-N,N',N'-triacetate,
triammonium ethylenediamine-N-(β-oxyethyl)-N,N',N'-triacetate,
propylenediaminetetraacetic acid,
disodium propylenediaminetetraacetic acid,
nitrilotriacetic acid,
trisodium nitrilotriacetate,
cyclohexanediaminetetraacetic acid,
disodium cyclohexanediaminetetraacetate,
iminodiacetic acid, dihydroxyethylglycine,
ethyl ether diaminetetraacetic acid,
glycol ether diaminetetraacetic acid,
ethylenediaminetetrapropionic acid,
phenylenediaminetetraacetic acid,
1,3-diaminopropanol-N,N,N',N'-tetramethylenephosphonic acid,
ethylenediamine-N,N,N',N'-tetramethylenephosphonic acid, and
1,3-propylenediamene-N,N,N',N'-tetramethylenephosphonic acid.

Ferric complex salts may be used in the form of a complex salt or a ferric salt such as ferric sulfate, ferric chloride, ferric nitrate, ammonium ferric sulfate, and a ferric phosphate and a chelate agent such as an aminopolycarboxylic acid, an aminopolyphosphonic acid, and a phosphonocarboxylic acid may be used to form a ferric complex salt in solution. When complex salts are used, one or a combination of two or more can be used. When a ferric salt and a chelate agent are used to form a complex salt in solution, one or more of ferric salts may be used. Further, one or more of chelate agents may also be used. In either case, a chelate agent may be used in excess to form a ferric ion complex salt. Among iron complex salts, aminopolycarboxylic acid iron complex salts are preferable, and suitable amount to be added are from 0.01 to 1.0 mol/liter, preferably 0.05 to 0.50 mol/liter.

Further, if required, the bleaching solution or the bleach-fixing solution may use a bleach accelerating agent. Specific examples of useful bleach accelerating agents are compounds having a mercapto group or a disulfide group described, for example, in U.S. Pat. No. 3,893,858, West German Patent Nos. 1,290,812 and 2,059,988, Japanese Patent Application (OPI) Nos. 32736/78, 57831/78, 37418/78, 65732/78, 72623/78, 95630/78, 95631/78, 104232/78, 124424/78, 141623/78 and 28426/78 and *Research Disclosure*, No. 17129 (July 1978); thiazolidine derivatives as described in Japanese Patent Application (OPI) No. 140129/75; thiourea derivatives described in Japanese Patent Publication No. 8506/70, Japanese Patent Application (OPI) Nos. 20832/77 and 32735/78 and U.S. Pat. No. 3,706,561; iodides described in West German Patent No. 1,127,715 and Japanese Patent Application (OPI) No. 16235/83; polyethylene oxides described in West German Patent Nos. 966,410 and 2,748,430; polyamine compounds described in Japanese Patent Publication No. 8836/70; and iodine and bromine ions and compounds described in Japanese Patent Application (OPI) Nos. 42434/74, 59644/74, 94927/78, 35727/79, 26506/80 and 163940/83. Of these, compounds having a mercapto group or a disulfide group are preferable in view of high accaleration effect, and, in particular, compounds described in U.S. Pat. No. 3,893,858, West German Patent No. 1,290,812 and Japanese Patent Application (OPI) No. 95630/78 are preferred.

Further, to the bleaching solution or the bleach-fixing solution used in the present invention can be added a rehaloganizing agent of a bromide (e.g., potassium bromide, sodium bromide and ammonium bromide), a chloride (e.g., potassium chloride, sodium chloride and ammonium chloride). or an iodide (e.g., ammonium iodide). If desired, one or more of inorganic acids, and organic acids that have a pH buffering function, and their alkali salts and ammonium salts such as boric acid, borax, sodium metaborate, acetic acid, sodium acetate, sodium carbonate, potassium carbonate, phosphorous acid, phosphoric acid, sodium phosphate, citric acid, sodium citrate, and tartaric acid and corrosion inhibitors such as guanidine and ammonium nitrate can be added.

The fixing agent used in the bleach-fixing solution or the fixing solution in the present invention can be any of known fixing agents such as thiosulfates, for example, sodium thiosulfate, and ammonium thiosulfate; thiocyanates, for example, sodium thiocyanate and ammonium thiocyanate; and water-soluble silver halide dissolving agents such as thioureas and thioether compounds, for example, ethylenebisthioglycolic acid and 3,6-dithia-1,8-octanediol, which may be used in combination. Special bleach-fixing solutions comprising a combination of a large amount of a halide such as potassium iodide with a fixing agent described in Japanese Patent Application (OPI) No. 155354/80 can also be used. In the present invention, the use of thiosulfates and particularly ammonium thiosulfate is preferable.

Preferably, the amount of the fixing agent used per liter is in the range of from 0.3 to 2 mols, more preferably 0.5 to 1.0 mol.

Preferably, the pH range of the bleach-fixing solution or the fixing solution in the present invention is from 3 to 10, more preferably 5 to 9. When the pH is lower than that, though the desilvering ability may be improved, deterioration of the solution and leucotization higher than that, the desilvering ability decreases, and stains are liable to occur.

To adjust the pH, for example, hydrochloric acid, sulfuric acid, nitric acid, acetic acid (glacial acetic acid), a bicarbonate, ammonia, sodium hydroxide, potassium hydroxide, sodium carbonate or potassium carbonate can be added as required.

Further, the bleach-fixing solution can contain various brightening agents, antifoamers, surface active agents, and organic solvents such as polyvinyl pyrrolidones, methanol.

The bleach-fixing solution or the fixing solution in the present invention may also contain, as a preservative, a sulfite ion releasing compound such as a sulfite (e.g., sodium sulfite, potassium sulfite and ammonium sulfite), a bisulfite (e.g., ammonium bisulfite, sodium bisulfite and potassium bisulfite) and a metabisulfite (e.g., potassium metabisulfite, sodium metabisulfite and ammonium metabisulfite). Preferably, these compounds are contained in an amount of about 0.02 to 0.50 mol/liter, more preferably 0.04 to 0.40 mol/liter in terms of sulfite ion.

Although, generally, as a preservative a sulfite is added, other compounds, for example, ascorbic acid, a carbonyl bisulfite adduct or a carbonyl compound can be added.

Further, a buffering agent, a brightening agent, a chelate agent and a moldproofing agent, etc., can be added if required.

The washing step of the present invention is described hereafter. In the present invention, instead of the usual "washing step", only the so-called "stabilizing step", for example, without a substantial washing step, can be used. Thus, in the present invention, the term "washing step" has a wide meaning as above.

Since the washing water quantity or the stabilizing solution quantity in the present invention varies depending on the number of baths of multi-countercurrent washing and the quantity of components of the preceding bath carried in by the photosensitive material, although it is hard to specify the exact quantity with particularity, it is better if the bleaching or fixing components in the final bath are decreased to up to about $1\times10^{-4}$ times the original amount. For example, in the case of three-tank countercurrent washing, it is preferable that the washing water quantity is about 1000 ml or more, more preferably 5000 ml or more, per $m^2$ of the photosensitive material. When it is desired to save water, the quantity used is 100 to 1000 ml per $m^2$ of the photosensitive material.

The washing step can be carried out in a short time of 90 sec. or less, usually in the range of 10 sec. to 90 sec. and preferably in the range of 10 sec. to 60 sec.

Further, the washing temperature is 45° C. or less, preferably 15° C. to 45° C., and more preferably 20° C. to 35° C.

The washing temperature is 15° to 45° C., preferably 20° to 35° C.

For the purpose of prevention of precipitation or for stabilizing the washing water, various known compounds may be added to the washing solution(s). For example, an inorganic phosphoric acid, a chelate agent such as aminopolycarboxylic acids and organic phosphonic acids, a fungicide or a moldcide for preventing bacteria, algae or mold from occurring, such as compounds as described, for example, in *Journal of Antibact. Antifung. Agents*, Vol. 11, No. 5, pages 207 to 223 (1983), and in Hiroshi Hori, *Bokin Bobai no Kagaku*, published by Sankyoh Shuppan K. K., (1982), a metal salt such as a magnesium salt and an aluminium salt, an alkali metal salt, an ammonium salt, and a surface active agent for preventing uneven washing or drying load may be added if required. Further, compounds described, for example, by West in *Photographic Science and Engineering*, Vol. 6, pages 344 to 359 (1965) may be added.

The present invention is particularly effective in the case wherein a chelate agent, a fungicide and a moldcide are added to the washing water and water is saved greatly by multi-countercurrent washing using two or more tanks. The present invention is also particularly effective in the case wherein instead of the usual washing stage, the multicountercurrent stabilizing process (a so-called stabilizing process) as described in Japanese Patent Application (OPI) No. 8543/82 is carried out. In these situations, it is better if the bleaching or fixing components in the final bath are decreased to about $5\times10^{-2}$ or below, preferably $1\times10^{-2}$ or below, times the original amounts.

For the purpose of stabilizing the image, various compounds are added to the stabilizing bath. For example, various buffering agents for adjusting the film pH to 3 to 8 (e.g., borates, metaborates, borax, phosphates, carbonates, potassium hydroxide, sodium hydroxide, ammonia water, monocarboxylic acids, dicarboxylic acids and polycarboxylic acids that are used in combination), and aldehydes such as formaldehyde can be mentioned. Further, chelate agents (e.g., inorganic phosphoric acids, aminopolycarboxylic acids, organic phosphonic acids, aminophosphonic acids and phosphonocarboxylic acids), fungicides (e.g., thiazole type fungicides, isothiazole type fungicides, halogenated phenols, sulfanilamide and benzotriazole), surface active agents, brightening agents, and hardening agents can be used, and two or more can be combined for the same or different purposes.

To improve the shelf stability of the resulting images, it is preferable to add, as a film pH adjusting agent after the processing, an ammonium salt such as ammonium chloride, ammonium nitrate, ammonium sulfate, ammonium phosphate, ammonium sulfite and ammonium thiosulfate.

In the case above wherein the amount of washing water is substantially saved, it is preferable to allow part or all of the overflow washing water to flow back to the preceding bleach-fixing bath or stablilizing bath for the purpose of decreasing the amount of discharge.

In a continuous processing in this step, to use replenishing solutions can prevent the solution compositions from fluctuating, thereby securing a constant finish. The replenishing amount can be decreased to half of the standard replenishing amount or can be further decreased to save cost, if desired.

Each processing bath may be provided, as required, with a heater, a temperature sensor, a level sensor, a circulating pump, a filter, a floating lid, a squeegee, nitrogen agitation equipment, air agitation equipment, etc.

The color photographic processing can be applied to any processing step wherein a color developing solution is used. For example, the color photographic processing can be applied to color paper, color reversal paper, color positive film, color negative film and color reversal film.

The present invention will be explained in greater detail with reference to the following examples but the present invention should not be construed as being limited thereto. Unless otherwise indicated, all parts, percents, ratios and the like are by weight.

EXAMPLE 1

A multi-layer color photographic printing paper having the following layer constitution on a paper support, the opposite surfaces of which were laminated with polyethylene, was prepared. The coating solutions were prepared as follows:

Preparation of a Coating Solution for a First Layer 27.2 ml of ethyl acetate and 7.7 ml of a solvent (Solv-1) were added to 16.6 g of yellow coupler ($ExY_1$) and 4.4 g of a dye stabilizer (Cpd-1) to dissolve them, and the solution was emulsified and dispersed in 185 ml of a 10% aqueous gelatin solution containing 8 ml of 10% sodium dodecylbenzenesulfonate. On the other hand, to a monodispersed cubic silver chlorobromide emulsion (silver bromide: 80.0 mol%; Ag: 70 g/kg) wherein the average grain size was 0.92 μm and the variation coefficient was 8.9%, was. added a blue-sensitive sensitizing dye shown below in an amount of $5.0\times10^{-4}$ mol per mol of silver to prepare an emulsion. The emulsified dispersion and the thus prepared emulsion were mixed to prepare a coating solution for a first layer to have the composition given below.

Coating solutions for second to seventh layers were prepared in the same manner as that for the coating solution for a first layer.

As gelatin hardening agent for each layer, 1-oxy-3,5-dichloro-s-triazine sodium salt was used.

As spectral sensitizing dyes for the layers the following dyes were used:

Blue-sensitive emulsion layer:

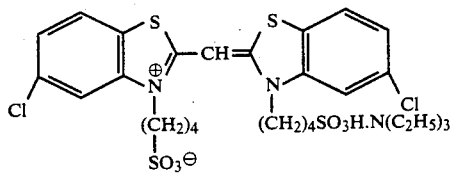

($5.0\times10^{-4}$ mol per mol of silver halide)

Green-sensitive emulsion layer:

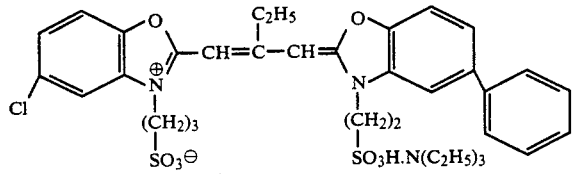

($4.0\times10^{-4}$ mol per mol of silver halide)

and

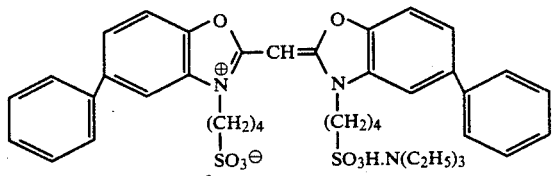

($7.0\times10^{-5}$ mol per mol of silver halide)

Red-Sensitive emulsion layer:

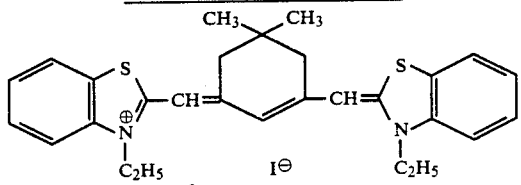

($9.0\times10^{-5}$ mol per mol of silver halide)

To the red-sensitive emulsion layer, was added the following compound in an amount of $2.6\times10^{-3}$ mol per mole of silver halide.

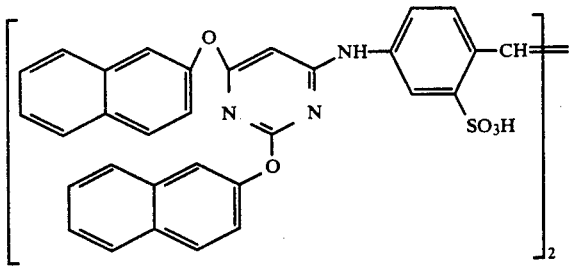

To the blue sensitive emulsion layer, the green-sensitive emulsion layer and the red-sensitive emulsion layer was added 1-(5-methylureidophenyl)-5-mercaptotetrazole in amounts of $4.0\times10^{-6}$ mol, $3.0\times10^{-5}$ mol, and $1.0\times10^{-5}$ mol per mol of silver halide respectively.

To the blue-sensitive emulsion layer and the green-sensitive emulsion layer was added 4-hydroxy-6-methyl-1,2,3a,7-tetraazaindene in amounts of $1.2\times10^{-2}$ mol and $1.1\times10^{-2}$ mol of silver halide respectively.

The composition of each layer is shown below. The number shows the coating amount (g/m²). The coating amount of the silver halide emulsion is given in terms of silver.

Support

Polyethylene-laminated paper (containing a white pigment ($TiO_2$) and a bluish dye (ultramarine) in the polyethylene on the first layer side).

| | |
|---|---|
| First layer (Blue-sensitive Layer) | |
| Monodispersed cubic silver bromochloride emulsion wherein the average grain size was 0.92 μm and the variation coefficient was 8.9% (Br: 80 mol %) | 0.26 |
| Gelatin | 1.83 |
| Yellow coupler ($ExY_1$) | 0.72 |
| Dye stabilizer (Cpd-1) | 0.19 |
| Solvent (Solv-1) | 0.35 |
| Second Layer (Color Mixing Preventing Layer) | |
| Gelatin | 0.99 |
| Color mixing preventing agent (Cpd-2) | 0.08 |
| Third Layer (Green-Sensitive Layer) | |
| Monodispersed cubic silver bromochloride emulsion wherein the average grain size was 0.50 μm and the variation coefficient was 10.5% (Br: 80 mol %) | 0.16 |
| Gelatin | 1.79 |
| Magenta coupler ($ExM_1$) | 0.32 |
| Dye stabilizer (Cpd-3) | 0.20 |
| Dye stabilizer (Cpd-4) | 0.01 |
| Solvent (Solv-2) | 0.65 |
| Fourth Layer (Ultraviolet Absorbing Layer) | |
| Gelatin | 1.58 |
| Ultraviolet absorbing agent (UV-1) | 0.62 |
| Color mixing preventing agent (Cpd-5) | 0.05 |
| Solvent (Solv-3) | 0.24 |
| Fifth Layer (Red-Sensitive Layer) | |
| Monodispersed cubic silver bromochloride emulsion wherein the average grain size was 0.48 μm and the variation coefficient was 9.8% (Br: 70 mol %) | 0.23 |
| Gelatin | 1.34 |
| Cyan coupler ($ExC_1$) | 0.30 |
| Dye stabilizer (Cpd-6) | 0.17 |
| Polymer (Cpd-7) | 0.40 |
| Solvent (Solv-4) | 0.23 |
| Sixth Layer (Ultraviolet Absorbing Layer) | |
| Gelatin | 0.53 |
| Ultraviolet absorbing agent (UV-1) | 0.21 |
| Solvent (Solv-3) | 0.08 |
| Seventh Layer (Protective Layer) | |
| Gelatin | 1.33 |
| Acryl-modified copolymer of polyvinyl alcohol (degree of modification: 17%) | 0.17 |
| Liquid paraffin | 0.03 |

Yellow coupler ($ExY_1$):

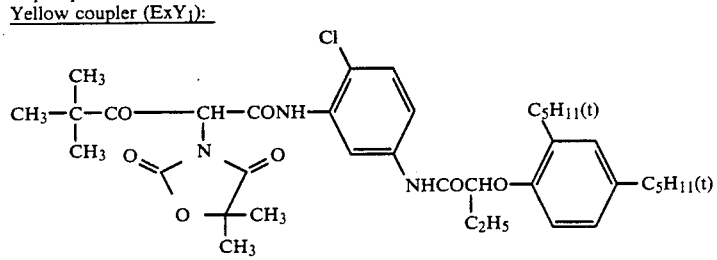

Magenta coupler ($ExM_1$):

-continued
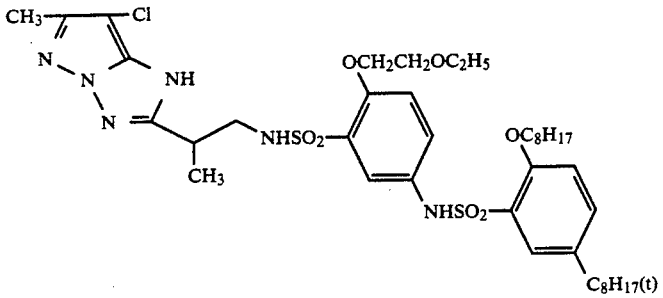
Cyan coupler (ExC1):
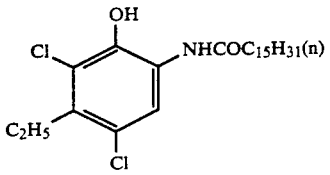
Dye stabilizer (Cpd-1):
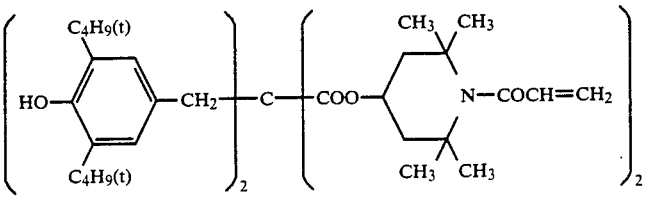
Color mixing preventing agent (Cpd-2):
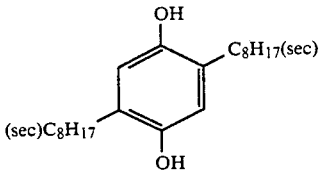
Dye stabilizer (Cpd-3):
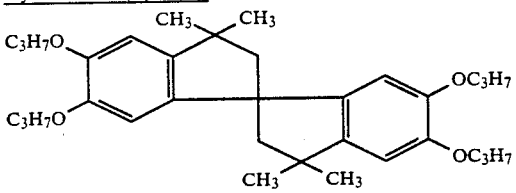
Dye stabilizer (Cpd-4):
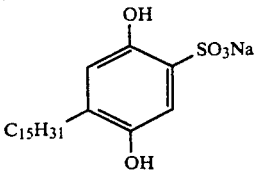
Color mixing preventing agent (Cpd-5):
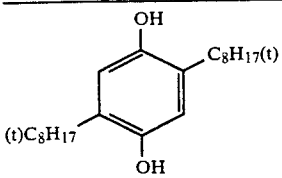
Dye stabilizer (Cpd-6):
A 2:5:5 (weight ratio) mixture of -continued
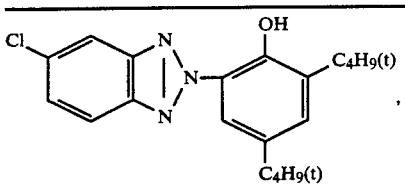
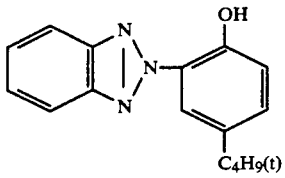
and
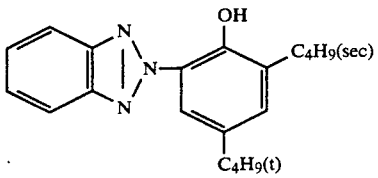
Polymer (Cpd-7):
$$\left(CH_2-\underset{\underset{CONHC_4H_9(t)}{|}}{CH}\right)_n$$
Average molecular weight 80,000
Ultraviolet absorbing agent (UV-1):
A 1:4:3 (weight ratio) mixture of
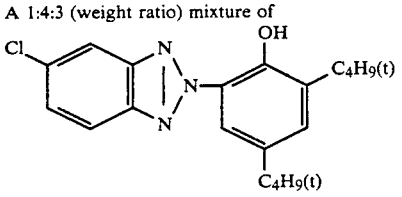
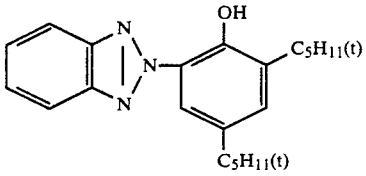
and
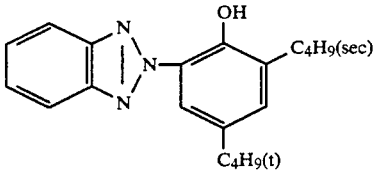
Solvent (Solv-1):
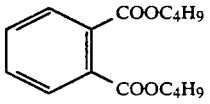
Solvent (Solv-2):
A 2:1 (volume ratio) mixture of
$$O{=}P\left(OCH_2\overset{\overset{C_2H_5}{|}}{C}HC_4H_9\right)_3$$

-continued and

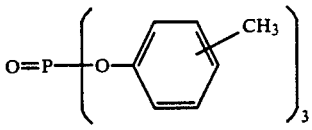

Solvent (Solv-3):

$O{=}P{+}O{-}C_9H_{19}(iso))_3$

Solvent (Solv-4):

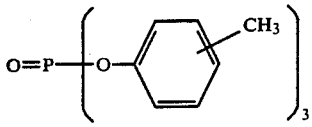

Dyes according to the present invention and a comparative dye were added to the above fourth layer to prepare Samples (1) to (11). The dyes are listed in Table 1. The amount of each of the dyes added was $2\times10^{-5}$ mol/m$^2$.

TABLE 1

| Sample No. | Dye |
|---|---|
| (1) This invention | Compound-3 |
| (2) This invention | Compound-5 |
| (3) This invention | Compound-37 |
| (4) This invention | Compound-8 |
| (5) This invention | Compound-10 |
| (6) This invention | Compound-5, Compound-8 |
| (7) This invention | Compound-37, Compound-10 |
| (8) Comparison | 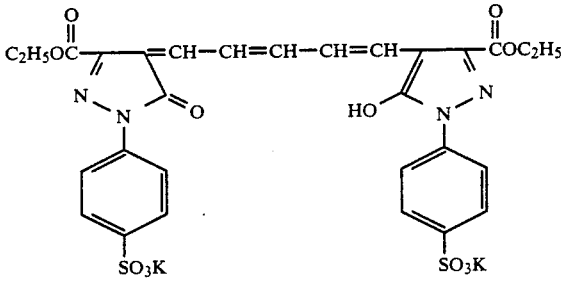 |
| (9) Comparison | 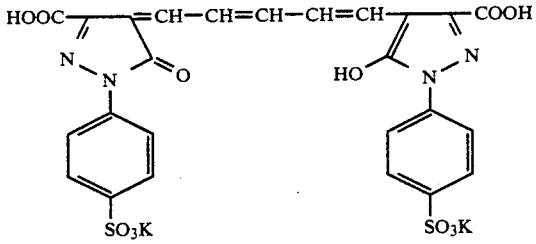 |
| (10) Comparison | 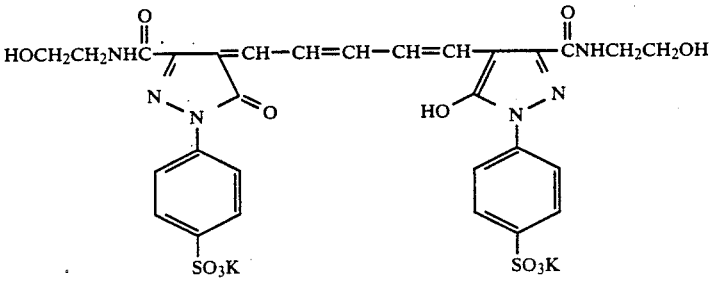 |

TABLE 1-continued

| Sample No. | Dye |
|---|---|
| (11) Comparison | 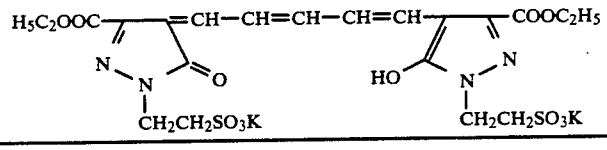 |

With respect to Samples (1) to (8), the stability of the dyes in the films and the dependence of exposure on humidity were examined. With respect to the stability, after the Samples stood for 2 weeks at conditions of 35° C. and 80% relative humidity, the residual ratio of each dye was assessed. With respect to the dependence of exposure on humidity, after the Samples were exposed to light at conditions of 25° C. and 55% relative humidity and of 25° C. and 85% relative humidity, the Samples were subjected to the processes shown below, and the relative sensitivity of the blue-sensitive layer (the change in sensitivity was greater) at an optical density of 1.0 was assessed. The results are shown in Table 2.

| Process | Temperature | Time |
|---|---|---|
| Color development | 33° C. | 3 min 30 sec |
| Bleach-fixing | 33° C. | 1 min 30 sec |
| Washing | 24 to 34° C. | 1 min |
| Drying | 70 to 80° C. | 1 min |

The composition of each of processing solutions was as follows.

| | |
|---|---|
| Color developing solution | |
| Water | 800 ml |
| Diethylenetriaminetetraacetic acid | 1.0 g |
| Nitrilotriacetic acid | 1.5 g |
| Benzyl alcohol | 15 ml |
| Diethylene glycol | 10 ml |
| Sodium sulfite | 2.0 g |
| Potassium bromide | 0.5 g |
| Potassium carbonate | 30 g |
| N-ethyl-N-(β-methanesulfonamidoethyl)-3-methyl-4-aminoaniline sulfate | 5.0 g |
| Hydroxylamine sulfate | 4.0 g |
| Bistriazinyldiaminostilbene derivative optical brightener (WHITEX4B manufactured by Sumitomo chemical Co., Ltd) | 1.0 g |
| Water to make | 1000 ml |
| pH (25° C.) | 10.20 |
| Bleach-fixing Solution | |
| water | 400 ml |
| Ammonium thiosulfate (70%) | 150 ml |
| Sodium sulfite | 18 g |
| Ethylenediaminetetraacetic acid iron (III) ammonium salt | 55 g |
| Disodium ethylenediaminetetraacetate | 5 g |
| water to make | 1000 ml |
| pH (25° C.) | 6.70 |

TABLE 2

| Sample No. | Residual ratio of dye | Relative sensitivity (25° C.-55%)* | Difference of relative sensitivities [(25° C.-85%)-(25° C.-55%)]* | Stain after processing** |
|---|---|---|---|---|
| (1) | 98% | 105 | −13 | 0.12 |
| (2) | 99% | 110 | −13 | 0.12 |
| (3) | 98% | 110 | −11 | 0.13 |
| (4) | 94% | 107 | −13 | 0.11 |
| (5) | 96% | 110 | −15 | 0.12 |
| (6) | — | 105 | −13 | 0.11 |

TABLE 2-continued

| Sample No. | Residual ratio of dye | Relative sensitivity (25° C.-55%)* | Difference of relative sensitivities [(25° C.-85%)-(25° C.-55%)]* | Stain after processing** |
|---|---|---|---|---|
| (7) | — | 110 | −11 | 0.11 |
| (8) | 64% | 100 | −26 | 0.25 |
| (9) | 75% | 102 | −18 | 0.20 |
| (10) | 55% | 102 | −17 | 0.18 |
| (11) | 49% | 98 | −25 | 0.23 |

*: 55% and 85% refer to relative humidity
**: Minimum concentration in cyan image As apparent from Table 2, Samples (1)to (7) using the dyes according to the present invention are excellent in stability in the films and high in relative sensitivity at conditions of 25° C. and 55% relative humidity and the relative sensitivity and also the stain after processing decreases less at 25° C. and 85% relative humidity.

EXAMPLE 2

With respect to the dependence of exposure on humidity, Samples (1) to (8) of Example 1 were assessed in the same way as that in Example 1, except the Samples were subjected to the processes shown below. The results are shown in Table 3.

| Process | Temperature | Time |
|---|---|---|
| Color development | 38° C. | 1 min 40 sec |
| Bleach-fixing | 30 to 34° C. | 1 min 00 sec |
| Rinsing (1) | 30 to 34° C. | 20 sec |
| Rinsing (2) | 30 to 34° C. | 20 sec |
| Rinsing (3) | 30 to 34° C. | 20 sec |
| Drying | 70 to 80° C. | 50 sec |

(The rinsing was a three-tank countercurrent process from the rinsing step (3) to the rinsing step (1).)

The composition of each of the processing solutions was as follows.

| | |
|---|---|
| Color Developing Solution | |
| Water | 800 ml |
| Diethylenetriaminetetraacetic acid | 1.0 g |
| 1-hydroxyethylidene-1,1-diphosphonic acid (60%) | 2.0 g |
| Nitrilotriacetic acid | 2.0 g |
| Triethylenediamine(1,4-diazabicyclo-[2,2,2]octane) | 5.0 g |
| Potassium bromide | 0.5 g |
| Potassium carbonate | 30 g |
| N-ethyl-N-(β-methanesulfonamidoethyl)-3-methyl-4-aminoaniline sulfate | 5.5 g |
| Diethylhydroxylamine | 4.0 g |
| Bistriazinyldiaminostilbene derivative optical brightener (UNITEX-CK manufactured by Ciba-Geigy) | 1.5 g |
| Water to make | 1000 ml |
| pH (25° C.) | 10.25 |

Rinsing Solution

Demineralized water (calcium and magnesium are respectively up to 3 ppm).

TABLE 3

| Sample No. | Difference of relative sensitivities [(25° C.-85%)-(25° C.-55%)] | Stain after processing* |
|---|---|---|
| (1) | −13 | 0.14 |
| (2) | −15 | 0.16 |
| (3) | −11 | 0.13 |
| (4) | −15 | 0.14 |
| (5) | −13 | 0.14 |
| (6) | −15 | 0.13 |
| (7) | −15 | 0.13 |
| (8) | −34 | 0.28 |
| (9) | −25 | 0.22 |
| (10) | −20 | 0.20 |
| (11) | −31 | 0.26 |

*: Measured by the similar method as in EXAMPLE 1.–

As apparent from Table 3, in Samples (1) to (7) using the dyes according to the present invention, the sensitivity and also the stain after processing decrease less under conditions of 25° C. and 85% relative humidity.

EXAMPLE 3

A multi-layer color photographic printing paper having the following layer constitution on a paper support, the opposite surfaces of which were laminated with polyethylene, was prepared The coating solutions were prepared as follows:

Preparation of a Coating Solution for a First Layer 27.2 ml of ethyl acetate and 7.7 ml of a solvent (Solv-1) were added to 19.1 g of yellow coupler ($ExY_2$) and 4.4 g of a dye stabilizer (Cpd-1) to dissolve them, and the solution was emulsified and dispersed in 185 ml of a 10% aqueous gelatin solution containing 8 ml of 10% sodium dodecylbenzenesulfonate. On the other hand, to a monodispersed cubic silver chlorobromide emulsion (silver bromide: 1.0 mol%; Ag 70 g/kg) wherein the average grain size was 0.96 μm and the variation coefficient was 9.2%, was added a blue-sensitive sensitizing dye shown below in an amount of $5.0\times10^{-4}$ mol per mol of silver to prepare an emulsion. The emulsified dispersion and the thus prepared emulsion were mixed to prepare a coating solution for a first layer to have the composition given below.

Coating solutions for second to seventh layers were prepared in the same manner as that for the coating solution for a first layer.

As gelatin hardening agent for each layer, 1-oxy-3,5-dichloro-s-triazine sodium salt was used.

As spectral sensitizing dyes for the layers the following dyes were used.

Blue-sensitive emulsion layer:

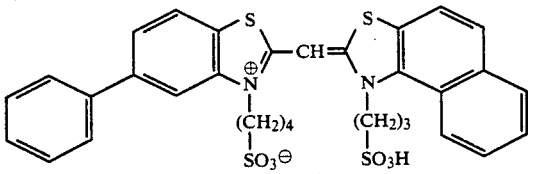

($5.0\times10^{-4}$ mol per mol of silver halide)

Green-sensitive emulsion layer:

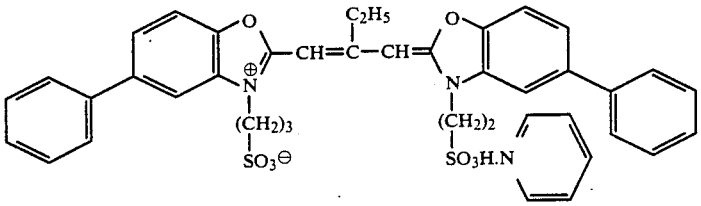

($4.0\times10^{-4}$ mol per mol of silver halide)

and

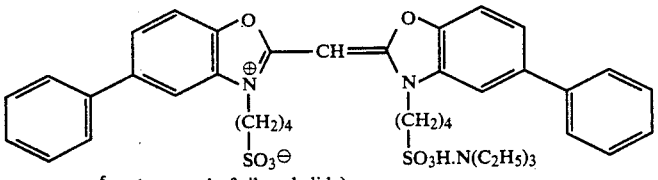

($7.0\times10^{-5}$ mol per mol of silver halide)

Red-Sensitive emulsion layer:

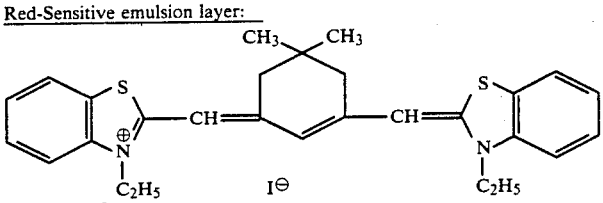

($9.0\times10^{-5}$ mol per mol of silver halide)

To the red-sensitive emulsion layer was added the following compound in an amount of $2.6\times10^{-3}$ mol per mol of silver halide.

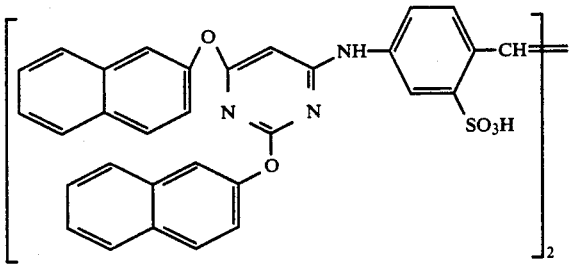

To the blue-sensitive emulsion layer, the green-sensitive emulsion layer and the red-sensitive emulsion layer was added 1-(5-methylureidophenyl)-5-mercaptotertrazole in amounts of $8.5\times10^{-5}$ mol, $7.7\times10^{-4}$ mol, and $2.5\times10^{-4}$ mol per mol of silver halide respectively.

The composition of each layer is shown below. The number shows the coating amount ($g/m^2$). The coating amount of the silver halide emulsion is given in terms of silver.

Support

Polyethylene-laminated paper (containing a white pigment ($TiO_2$) and a bluish dye(ultramarine) in the polyethylene on the first layer side).

| | |
|---|---|
| First Layer (Blue-Sensitive Layer) | |
| Monodispersed cubic silver bromochloride emulsion wherein the average grain size was 0.96 μm and the variation coefficient was 9.2% (Br: 1 mol %) | 0.30 |
| Gelatin | 1.86 |
| Yellow coupler ($ExY_2$) | 0.82 |
| Dye stabilizer (Cpd-1) | 0.19 |
| Solvent (Solv-1) | 0.35 |
| Second Layer (Color Mixing Preventing Layer) | |
| Gelatin | 0.99 |
| Color mixing preventing agent (Cpd-2) | 0.08 |
| Third Layer (Green-Sensitive Layer) | |
| Monodispersed cubic silver bromochloride emulsion wherein the average grain size was 0.54 μm and the variation coefficient was 10.0% (Br: 1 mol %) | 0.36 |
| Gelatin | 1.24 |
| Magenta coupler ($ExM_2$) | 0.31 |
| Dye stabilizer (Cpd-3) | 0.25 |
| Dye stabilizer (Cpd-8) | 0.12 |
| Solvent (Solv-2) | 0.42 |
| Fourth Layer (Ultraviolet Absorbing Layer) | |
| Gelatin | 1.58 |
| Ultraviolet absorbing agent (UV-1) | 0.62 |
| Color mixing preventing agent (Cpd-5) | 0.05 |
| Solvent (Solv-3) | 0.24 |
| Fifth Layer (Red-Sensitive Layer) | |
| Monodispersed cubic silver bromochloride emulsion wherein the average grain size was 0.55 μm and the variation coefficient was 10.3% (Br: 1 mol %) | 0.23 |
| Gelatin | 1.34 |
| Cyan coupler ($ExC_2$) | 0.34 |
| Dye stabilizer (Cpd-6) | 0.17 |
| Polymer (Cpd-7) | 0.40 |
| Solvent (Solv-4) | 0.23 |
| Sixth Layer (Ultraviolet Absorbing Layer) | |
| Gelatin | 0.53 |
| Ultraviolet absorbing agent (UV-1) | 0.21 |
| Solvent (Solv-3) | 0.08 |
| Seventh Layer (Protective Layer) | |
| Gelatin | 1.33 |
| Acryl-modified copolymer of polyvinyl alcohol (degree of modification: 17%) | 0.17 |
| Liquid Paraffin | 0.03 |
| Yellow coupler ($ExY_2$): | |

-continued

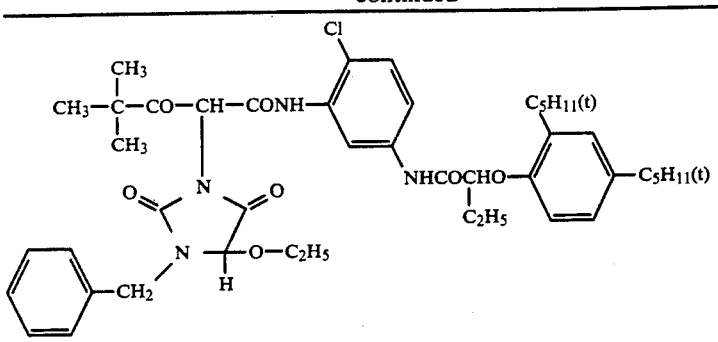

Magenta coupler (ExM2):

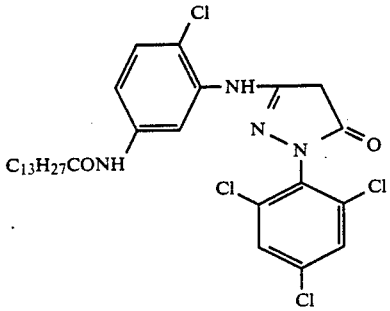

Cyan coupler (ExC2):

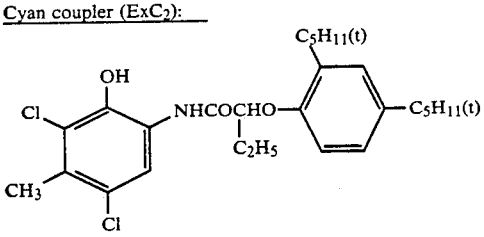

Dye stabilizer (Cpd-8):

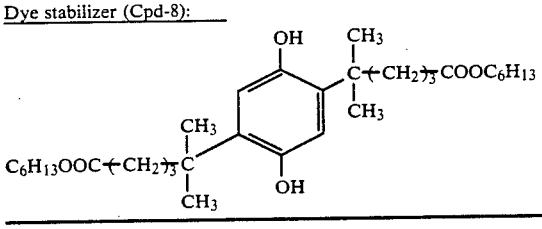

Dyes according to the present invention and a comparative dye were added to the above fourth layer to prepare Samples (12) to (19). The dyes are listed in TAble 4. The amount of each of the dyes added was $2\times10^{-5}$ mol/m$^2$.

TABLE 4

| | Sample No. | Dye |
|---|---|---|
| (12) | This invention | Compound-16 |
| (13) | This invention | Compound-34 |
| (14) | This invention | Compound-37 |
| (15) | This invention | Compound-10 |
| (16) | This invention | Compound-12 |
| (17) | This invention | Compound-16, Compound-8 |
| (18) | This invention | Compound-37, Compound-10 |
| (19) | Comparison | |

TABLE 4-continued

| Sample No. | Dye |
|---|---|
| | 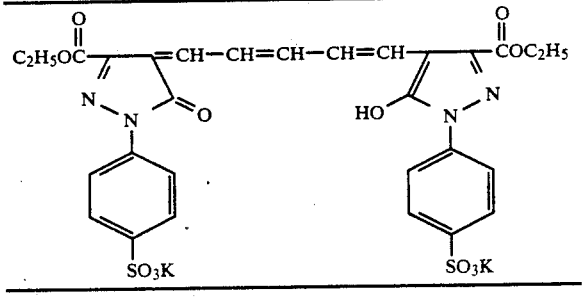 |

With respect to Samples (9) to (16), the dependence of exposure on humidity was examined. With respect to the dependence of exposure on humidity, after Samples were exposed to light at conditions of 25° C. and 55% relative humidity and of 25° C. and 85% relative humidity, the Samples were subjected to the processes shown below, and the relative sensitivity of the blue-sensitive layer (the change in sensitivity was greater) at an optical density of 1.0 was assessed. The results are shown in Table 5.

| Process | Temperature | Time |
|---|---|---|
| Color devlopment | 35° C. | 45 sec |
| Bleach-fixing | 30 to 36° C. | 45 sec |
| Stabilizing (1) | 30 to 37° C. | 20 sec |
| Stabilizing (2) | 30 to 37° C. | 20 sec |
| Stabilizing (3) | 30 to 37° C. | 20 sec |
| Stabilizing (4) | 30 to 37° C. | 20 sec |
| Drying | 70 to 85° C. | 60 sec |

(The stabilizing was a four tank countercurrent process from the stabilizing step (4) to the stabilizing step (1).)

The composition of each of processing solutions was as follows.

| | |
|---|---|
| Color Developing Solution | |
| Water | 800 ml |
| Ethylenediaminetetraacetic acid | 2.0 g |
| Triethanolamine | 8.0 g |
| Sodium chloride | 1.4 g |
| Potassium carbonate | 25 g |
| N-ethyl-N-(β-methanesulfonamidoethyl)-3-methyl-4-aminoaniline sulfate | 5.0 g |
| N,N-diethylhydroxylamine | 4.2 g |
| 5,6-dihydroxybenzene-1,2,4-trisulfonic acid | 0.3 g |
| Brightening agent (4,4'-diaminostilbene type) | 2.0 g |
| Water to make | 1000 ml |
| pH (25° C.) | 10.10 |
| Bleach-fixing Solution | |
| Water | 400 ml |
| Ammonium thiosulfate (70%) | 100 ml |
| Sodium sulfite | 18 g |
| Ethylenediaminetetraacetic acid iron (III) ammonium salt | 55 g |
| Disodium ethylenediaminetetraacetate | 3 g |
| Glacial acetic acid | 8 g |
| Water to make | 1000 ml |
| pH (25° C.) | 5.5 |
| Stabilizing Solution | |
| Formalin (37%) | 0.1 g |
| Formalin/sulfurous acid adduct | 0.7 g |
| 5-chloro-2-methyl-4-isothiazolin-3-one | 0.02 g |
| 2-methyl-4-isothiazolin 3-one | 0.01 g |
| Copper sulfate | 0.005 g |
| Water to make | 1000 ml |
| pH (25° C.) | 4.0 |

TABLE 5

| Sample No. | Difference of relative sensitivities [(25° C.-85%)-(25° C.-55%)] | Stain after processing* |
|---|---|---|
| (12) | −17 | 0.11 |
| (13) | −15 | 0.12 |
| (14) | −15 | 0.12 |
| (15) | −17 | 0.13 |
| (16) | −15 | 0.11 |
| (17) | −15 | 0.12 |
| (18) | −17 | 0.11 |
| (19) | −38 | 0.22 |

*: Measured by the similar method as in EXAMPLE 1.–

As apparent from Table 5, Samples (9) to (15) using the dyes according to the present invention are excellent in that the sensitivity upon exposure at a high humidity and also the stain after processing decrease less and it is indicated that the dyes according to the present invention are excellent.

According to the present invention, silver halide photographic materials having a hydrophilic colloid layer containing a novel dye that will be decolored by photographic processing, and will not adversely affect the photographic characteristics of the photographic emulsions, particularly the spectral sensitivity, can be provided.

According to the present invention, silver halide photographic materials excellent in stability with time and low in dependence on exposure to light can be provided.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide photographic element comprising the steps of:

(a) imagewise exposing a silver halide photographic element to actinic radiation;

(b) developing the resulting element of step (a); and (c) washing the resulting element of step (b); wherein the washing in step (c) is carried out at at least 15° C. to 45° C. for at least 10 sec. to 90 sec., and wherein the silver halide color photographic element comprises a support having provided thereon at least one silver halide emulsion layer, wherein the silver halide photographic element contains in a hydrophilic colloid layer, from 2 mg/m$^2$ to 40 mg/m$^2$ of at least one dye represent by the following general formula (I):

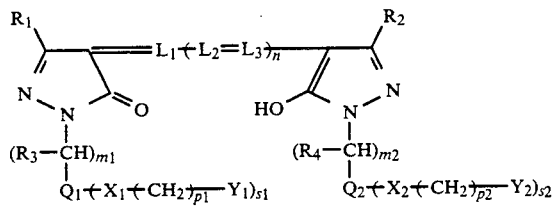

(I)

wherein $R_1$ and $R_2$, which are the same or different, each represents —COOR$_5$, or

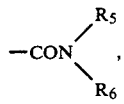

$R_3$ and $R_4$, which are the same or different, each represents a hydrogen atom or an alkyl group, $R_5$ and $R_6$, which are the same or different, each represents a hydrogen atom, a substituted or unsubstituted alkyl group, a substituted or unsubstituted aryl group, when $R_1$ and $R_2$ represent —COOR$_5$ and $R_5$ represents a hydrogen atom, $R_1$ and $R_2$ represent a carboxyl group which can for a salt, $R_5$ and $R_6$ can combine together to form a 5-or 6-membered ring, $Q_1$ and $Q_2$, which are the same or different, each represents a substituted or unsubstituted aryl group, $X_1$ and $X_2$, which are the same or different, each represents a divalent linking group or a bond, $Y_1$ and $Y_2$, which are the same or different, each represents a sulfo group or a carboxyl group which can form a salt, $L_1$, $L_2$ and $L_3$, which are the same or different, each represents a substituted or unsubstituted methine group, $m_1$ and $m_2$ each is 1 or 2, n is 0, 1 or 2, $p_1$ and $p_2$ each is 0, 1, 2, 3, or 4, and $s_1$ and $s_2$ each is 1 or 2.

2. The method for processing material as claimed in claim 1, wherein said $R_5$ and $R_6$ each represents a hydrogen atom, an unsubstituted alkyl group, a substituted alkyl group which is substituted by a sulfo group, a carboxyl group, a hydroxyl group, an alkoxy group, a halogen atom, a cyano group, a sulfonyl group, a nitro group, an amino group, or an aryl group, an unsubstituted aryl group or a substituted aryl group which is substituted by a sulfo group, a carboxyl group, a hydroxy group, an alkoxy group, a halogen atom, a cyano group, a nitro group, an amino group or an alkyl group.

3. The method for processing material as claimed in claim 1, wherein said $Q_1$ and $Q_2$ each represents an unsubstituted aryl group or a substituted aryl group which is substituted by an alkyl group having 1 to 4 carbon atoms, and alkoxy group having 1 to 4 carbon atoms, a halogen atom, a carbamoyl group, a sulfamoyl group, a cyano group, a nitro group, an alkylsulfonyl group, an arylsulfonyl group, an amino group, an acylamino group or a sulfonamido group.

4. The method for processing material as claimed in claim 1, wherein said $X_1$ and $X_2$ each represents a divalent linking group selected from $$-\overset{R_7}{\overset{|}{N}}-,\ -\overset{R_7}{\overset{|}{N}}-CO-,\ -SO_2-,\ \text{or}\ -\overset{R_7}{\overset{|}{N}}-SO_2-,$$

or a bond, wherein $R_7$ represents a hydrogen atom, an unsubstituted alkyl group having up to 5 carbon atoms or a substituted alkyl group having up to 5 carbon atoms which is substituted by an alkoxy group having up to 3 carbon a sulfo group, a carboxyl group, a cyano group, a hydroxy group, an amino group, a sulfonamido group, a carbonamido group, a carbamoyl group or a sulfamoyl group.

5. The method for processing material as claimed in claim 1, wherein said $L_1$, $L_2$ and $L_3$ each represents an unsubstituted methine group or a substituted methine group which is substituted by a methyl group, an ethyl group, or a phenyl group.

6. The method for processing material as claimed in claim 1, wherein $R_3$ and $R_4$ each represents a hydrogen atom or a methyl group.

7. The method for processing material as claimed in claim 1, wherein $R_5$ and $R_6$ each represents a hydrogen atom, an alkyl group having up to 4 carbon atoms, a substituted alkyl group having up to 6 carbon atoms, a phenyl group or a substituted phenyl group.

8. The method for processing material as claimed in claim 1, wherein $R_5$ and $R_6$ combine together to form a 5- or 6-membered ring.

9. The method for processing material as claimed in claim 1, wherein $Q_1$ and $Q_2$ each represents a phenyl group or a substituted phenyl group.

10. The method for processing material as claimed in claim 1, wherein $X_1$ and $X_2$ each represents -0-, $$-\overset{R_7}{\overset{|}{N}}-$$

or a bond, wherein $R_7$ represents a hydrogen atom, an alkyl group having up to 5 carbon atoms or a substituted alkyl group having up to 5 carbon atoms.

11. The method for processing material as claimed in claim 1, wherein $m_1$ and $m^2$ are both 1.

12. The method for processing material as claimed in claim 1, wherein the hydrophilic colloid layer is an emulsion layer, an intermediate layer, a protective layer, an antihalation layer or a filter layer.

13. The method for processing material as claimed in claim 1, wherein said at least one dye is present in an amount effective to provide said material with an optical density of from about 0.05 to about 3.0.

14. The method for processing as claimed in claim 1, wherein said photographic element is selected from the group consisting of color positive films, color papers, color negative films, color reversal films photosensitive elements for photomechanical process, photosensitive elements for silver salt diffusion transfer processes, photosensitive elements for color diffusion transfer processes, photosensitive elements for inhibition transfer processes, photosensitive elements for use in silver dye bleaching methods, photosensitive elements for recording print-out images, photosensitive elements for direct print images, photosensitive elements for heat development, and photosensitive elements for physical development.

15. The method for processing as claimed in claim 1, wherein the washing step is carried out at 20° C. to 35° C.

* * * * *